US012523001B2

(12) United States Patent
Honda

(10) Patent No.: US 12,523,001 B2
(45) Date of Patent: Jan. 13, 2026

(54) EXCAVATOR, AND EXCAVATOR OPERATION SYSTEM

(71) Applicant: SUMITOMO HEAVY INDUSTRIES, LTD., Tokyo (JP)

(72) Inventor: Keiji Honda, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 114 days.

(21) Appl. No.: 18/545,179

(22) Filed: Dec. 19, 2023

(65) Prior Publication Data

US 2024/0209591 A1 Jun. 27, 2024

(30) Foreign Application Priority Data

Dec. 26, 2022 (JP) ..... 2022-208034

(51) Int. Cl.
*E02F 3/43* (2006.01)

(52) U.S. Cl.
CPC ..... *E02F 3/437* (2013.01)

(58) Field of Classification Search
CPC ... E02F 3/437; E02F 3/32; E02F 9/205; E02F 9/00; E02F 9/20; E02F 9/2025; E02F 9/2029; E02F 9/2037; E02F 9/2041; E02F 9/2058; E02F 9/22; E02F 9/2203; E02F 9/2221; E02F 9/2264; E02F 9/2285
See application file for complete search history.

(56) References Cited

U.S. PATENT DOCUMENTS

| | | | | |
|---|---|---|---|---|
| 11,414,841 | B2 * | 8/2022 | Moriki | E02F 3/43 |
| 2009/0218112 | A1 * | 9/2009 | Mintah | E02F 3/437 701/50 |
| 2018/0002899 | A1 * | 1/2018 | Morimoto | E02F 3/43 |
| 2018/0148905 | A1 * | 5/2018 | Matsuyama | E02F 3/32 |
| 2018/0266071 | A1 * | 9/2018 | Matsuyama | E02F 9/2004 |
| 2019/0194905 | A1 * | 6/2019 | Matsuyama | E02F 9/2041 |
| 2020/0277752 | A1 * | 9/2020 | Igarashi | E02F 9/262 |
| 2021/0010239 | A1 * | 1/2021 | Ono | E02F 9/2041 |
| 2021/0262190 | A1 * | 8/2021 | Ito | E02F 9/205 |
| 2021/0262191 | A1 * | 8/2021 | Ito | E02F 9/205 |
| 2022/0010519 | A1 * | 1/2022 | Izumikawa | E02F 9/2004 |
| 2022/0081873 | A1 * | 3/2022 | Huissoon | B66F 11/044 |
| 2022/0145580 | A1 * | 5/2022 | Igarashi | E02F 9/2029 |
| 2022/0316173 | A1 * | 10/2022 | Narikawa | E02F 9/2203 |

(Continued)

FOREIGN PATENT DOCUMENTS

| | | | |
|---|---|---|---|
| JP | 62164921 A | * | 7/1987 |
| JP | S62-164921 | | 7/1987 |
| JP | 2013-217137 | | 10/2013 |

(Continued)

OTHER PUBLICATIONS

JP-2013217137-A machine translation (Year: 2013).*

(Continued)

*Primary Examiner* — Fadey S. Jabr
*Assistant Examiner* — Mark Robert Heim
(74) *Attorney, Agent, or Firm* — IPUSA, PLLC

(57) ABSTRACT

An excavator includes a controller that selects, in a machine control function, a master element and a slave element among a plurality of moving elements constituting an attachment, based on a plurality of information representing details of operations for the plurality of moving elements.

20 Claims, 14 Drawing Sheets

(56) References Cited

U.S. PATENT DOCUMENTS

2024/0318402 A1* 9/2024 Honda ..... E02F 3/437

FOREIGN PATENT DOCUMENTS

| | | | | | |
|---|---|---|---|---|---|
| JP | 2013217137 | A | * | 10/2013 | |
| JP | 6964109 | B2 | * | 11/2021 | ..... E02F 9/2285 |
| WO | WO-2022085556 | A1 | * | 4/2022 | ..... E02F 9/264 |

OTHER PUBLICATIONS

JP-62164921-A machine translation (Year: 1987).*
WO-2022085556-A1 machine translation (Year: 2022).*
JP-6964109-B2 machine translation (Year: 2021).*

* cited by examiner

EXCAVATOR, AND EXCAVATOR OPERATION SYSTEM

CROSS-REFERENCE TO RELATED APPLICATION

This application is based on and claims priority to Japanese Patent Application No. 2022-208034, filed on Dec. 26, 2022, the entire contents of which are incorporated herein by reference.

BACKGROUND OF THE INVENTION

1. Field of the Invention

The present invention relates to an excavator and an excavator operation system.

2. Description of the Related Art

Conventionally, excavators that move their bucket teeth along the design surface by using machine control have been known.

SUMMARY OF THE INVENTION

Technical Problem

According to conventional techniques, the speed of an excavator's bucket teeth relative to the design surface is adjusted according to the distance between the bucket teeth and the design surface, in accordance with operation of the arm by the operator. Consequently, when using a conventional excavator, the excavator needs to be operated differently when machine control is used and when machine control is not used, and some operators may feel stressed to operate such an excavator.

The present invention has been made in view of the foregoing, and it is therefore an object of the present invention to reduce the stress that the operator of an excavator feels.

Solution to Problem

In order to achieve the above object, an excavator according to an embodiment of the present disclosure includes a controller that is configured to select, in a machine control function, a master element (or, main element) and a slave element (or, subordinate element) among a plurality of moving elements constituting an attachment, based on a plurality of information representing details of operations for the plurality of moving elements.

In order to achieve the above object, an excavator operation system according to an embodiment of the present disclosure includes an excavator and an information processing device that communicates with the excavator, and the system includes a controller that is configured to select, in a machine control function, a master element and a slave element among a plurality of moving elements constituting an attachment, based on a plurality of information representing details of operations for the plurality of moving elements.

Advantageous Effects of the Invention

According to the present invention, it is possible to reduce the stress that the operator of an excavator feels.

DETAILED DESCRIPTION OF THE PREFERRED EMBODIMENTS

An embodiment of the present invention (hereinafter "present embodiment") will be described below with reference to the accompanying drawings. First, an overview of an excavator 100 according to the present embodiment will be described with reference to FIG. 1 and FIG. 2.

Figure 1:
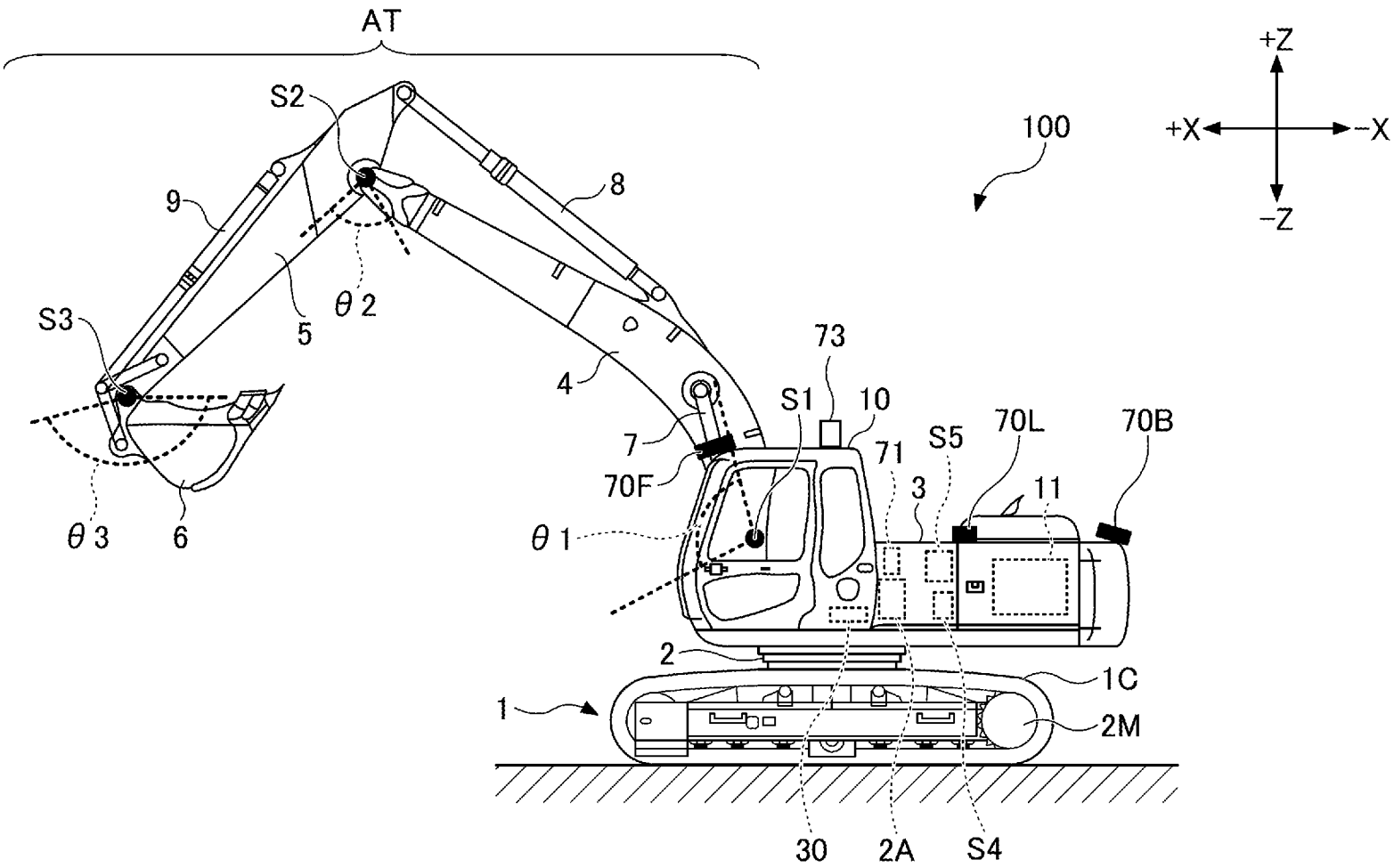
FIG. 1 is a side view of an excavator.
Figure 2:
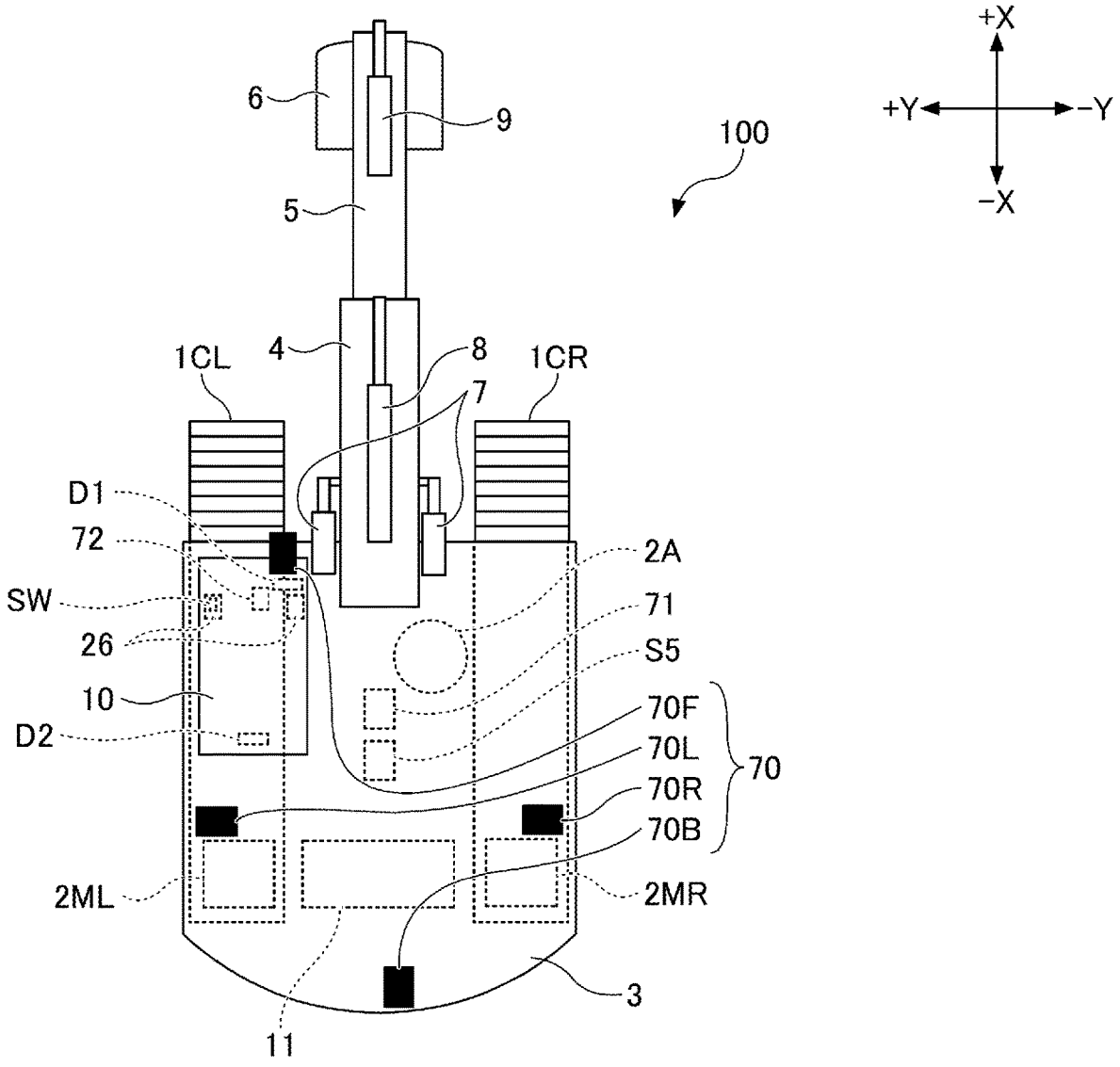
FIG. 2 is a top view of the excavator.

FIG. 1 and FIG. 2 are a top view and a side view, respectively, of the excavator 100 according to the present embodiment.

The excavator 100 according to the present embodiment includes: a lower traveling body 1; an upper rotating body 3 that is rotatably mounted on the lower traveling body 1 via a rotating mechanism 2; an attachment AT constituted by a boom 4, an arm 5, and a bucket 6; and a cabin 10.

As will be described below, the lower traveling body 1 (an example of a traveling body) includes a pair of left and right crawlers 1C, namely a left crawler 1CL and a right crawler 1CR. In the lower traveling body 1, the left crawler 1CL and the right crawler 1CR are hydraulically driven by drive hydraulic motors 2M (2ML and 2MR), thereby allowing the excavator 100 to travel.

The upper rotating body 3 (an example of a rotating body) is driven by a rotary hydraulic motor 2A, and rotates relative to the lower traveling body 1.

The boom 4 is pivotally attached to the front center of the upper rotating body 3 such that the boom 4 can look up and down. At the tip of the boom 4, the arm 5 is pivotally attached such that the arm 5 can move upward and downward in a rotary motion. The bucket 6 that serves as an end attachment is pivotally attached to the tip of the arm 5 such that the bucket 6 can move upward and downward in a rotary motion. The boom 4, the arm 5, and the bucket 6 are hydraulically driven, respectively, by a boom cylinder 7, an arm cylinder 8, and a bucket cylinder 9, which serve as hydraulic actuators.

Note that the bucket 6 is an example of an end attachment, and a different attachment, such as a slope bucket, a dredging bucket, a breaker, and the like may be attached to the tip of the arm 5, instead of the bucket 6, depending on the details of work.

The cabin 10 is the driver's room where the operator boards, and is mounted on the front left side of the upper rotating body 3.

The excavator 100 runs the actuators in accordance with operations made by the operator in the cabin 10, and drives the moving elements (driven elements) such as the lower traveling body 1, upper rotating body 3, boom 4, arm 5, and bucket 6.

Also, although the excavator 100 is structured such that the operator in the cabin 10 can operate it, instead of or in addition to this, the excavator 100 may be structured such that it can be operated remotely by the operator of a predetermined external device (for example, an assisting device or a managing device).

In this case, the excavator 100 transmits, for example, image information (captured images) output by a space recognition device 70, which will be described later, to the external device. Also, images pertaining to a variety of information (for example, various setting screens) displayed on a display device D1 of the excavator 100, which will be described later, may be similarly displayed on a display device provided in the external device.

By this means, the operator can remotely operate the excavator 100 by checking the contents displayed on the display device provided in the external device, for example. Then, the excavator 100 may run the actuators in accordance with remote operation signals that the excavator 100 receives from the external device, and that represent the details of remote operation, and drive the moving elements such as the lower traveling body 1, upper rotating body 3, boom 4, arm 5, and bucket 6.

When the excavator 100 is operated remotely, the cabin 10 may be unmanned. The following description will be made on the premise that the operation by the operator refers to at least one of operation that the operator in the cabin 10 makes to the operating devices 26, and remote operation by the operator of an external device.

Also, the excavator 100 may run the hydraulic pressure system automatically, regardless of the details of operation by the operator. By this means, the excavator 100 implements a function to allow at least some of the moving elements such as the lower traveling body 1, upper rotating body 3, boom 4, arm 5, and bucket 6, to move automatically (hereinafter referred to as "automatic driving function" or "machine control function").

The automatic driving function may include a function (referred to as "semi-automatic driving function") to allow moving elements (hydraulic actuators) other than the moving element (hydraulic actuator) being operated, in accordance with the operator's operation on the operating devices 26 or remote operation. Also, the automatic driving function may include a function (referred to as "fully-automatic driving function") to allow at least part of the driven elements (hydraulic actuators) to run automatically, on the premise that the operating devices 26 are not operated or remotely operated by the operator.

In the excavator 100, when the fully-automatic driving function is enabled, the cabin 10 may be unmanned. Also, the automatic driving function may include a function ("gesture operation function") to allow the excavator 100 to recognize the gestures of people such as workers around the excavator 100, and allow at least part of the driven elements (hydraulic actuators) to run automatically depending on the details of recognized gestures.

Also, the semi-automatic driving function, the fully-automatic driving function, and the gesture operation function may include a mode in which the details of movement of the moving element (hydraulic actuator) subject to automatic driving are determined automatically according to predefined rules. Also, the semi-automatic driving function, the fully-automatic driving function, and the gesture operation function may include a mode (referred to as "autonomous driving function"), in which the excavator 100 autonomously makes various decisions, and in which, based on these decisions, the excavator 100 autonomously determines the details of the movement of the moving element (hydraulic actuator) subject to automatic driving.

Also, the control system of the excavator 100 includes a controller 30, a space recognition device 70, an orientation detection device 71, an input device 72, a positioning device 73, a display device D1, a sound output device D2, a boom angle sensor S1, an arm angle sensor S2, a bucket angle sensor S3, a body inclination sensor S4, and a rotating state sensor S5.

The controller 30 controls the excavator 100, as described above.

For example, the controller 30 sets a target number of rotations per unit time based on a work mode that is configured in advance by a predetermined operation made on the input device 72 by the operator or the like, and exercises drive control to allow the engine 11 to rotate a certain number of times.

Also, for example, the controller 30 outputs, when needed, control commands to regulators 13, to change the amount of discharge by main pumps 14.

Also, for example, when the operating devices 26 are electrical, the controller 30 may control proportional valves 31, as described above, such that the hydraulic actuators run in accordance with the details of operations made on the operating devices 26.

For example, the controller 30 may implement remote operation of the excavator 100 by using a proportional valve 31.

To be more specific, the controller 30 may output, to a proportional valve 31, a control command that corresponds to the details of remote operation specified in a remote operation signal received from an external device. Then, using the hydraulic oil supplied from a pilot pump 15, the proportional valve 31 may output a pilot pressure that matches the control command from the controller 30, and apply the pilot pressure to a pilot port of a corresponding control valve in a control valve unit 17. By this means, the details of remote operation are mirrored in the movement of the control valve unit 17, and the hydraulic actuators allow various moving elements (driven elements) to move in accordance with the details of remote operation.

Also, for example, the controller 30 exercises control that relates to a surrounding monitoring function. The surrounding monitoring function monitors entry of a monitoring target object in a predetermined range around the excavator 100 (hereinafter referred to as "monitoring range"), based on information acquired by the space recognition device 70. The process of monitoring entry of the monitoring target object in the monitoring range may be performed by the space recognition device 70, or may take place outside the space recognition device 70 (for example, in the controller 30). The monitoring target object may be, for example, people, trucks, other construction machines, utility poles, hanging loads, pylons, buildings, and so forth.

Also, for example, the controller 30 exercises control related to an object detection notification function. When, for example, the presence of a monitoring target object is identified in the monitoring range by the surrounding monitoring function, the object detection notification function reports the presence of the monitoring target object to the operator in the cabin 10 and to the surroundings of the excavator 100. The controller 30 may implement the object detection notification function by using, for example, the display device D1, a sound output device D2, or the like.

Also, for example, the controller 30 exercises control related to a movement limiting function. When, for example, the presence of a monitoring target object is identified in the monitoring range by the surrounding monitoring function, the movement limiting function limits the movement of the excavator 100. The following description will focus on a case in which the monitoring target object is a person.

For example, the controller 30 may be configured such that, before the actuators start running, if a monitoring target object such as a person is identified to be present in a predetermined range from the excavator 100 (that is, in the monitoring range) based on information acquired by the space recognition device 70, the operator is unable to run the actuators even if the operator operates the operating devices 26, or the actuators are limited to run only at low speed.

To be more specific, when a person is identified to be present in the monitoring range, the controller 30 can make the actuators inoperable by locking a gate lock valve. In case the operating devices 26 are electrical, the actuators can be made inoperable by disabling the signals sent from the controller 30 to the operation proportional valves (proportional valves 31).

Even when other types of operating devices 26 are used, the same applies if operation proportional valves (proportional valves 31) that output pilot pressures that match the control commands from the controller 30 and apply these pilot pressures to the pilot ports of corresponding control valves in the control valve unit 17 are used.

If it is desirable to make the actuators run slowly, the control signals from the controller 30 to the operation proportional valves (proportional valves 31) may be limited to details that correspond to relatively low pilot pressures, thereby making the actuators run only in slow mode.

In this way, once a monitoring target object that is subject to detection is identified to be present in the monitoring range, even if the operating devices 26 are operated, the actuators are not driven, or are driven only at a movement speed (slow speed) that is slower than the movement speed that matches the operation input to the operating devices 26. Furthermore, with the excavator 100, if a monitoring target object such as a person is identified to be present in the monitoring range while the operator is operating the operating devices 26, the actuators may be stopped or decelerated regardless of the operator's operation.

To be more specific, if a person is identified to be present in the monitoring range, the actuators may be stopped by locking the gate lock valve. In the event operation proportional valves (proportional valves 31) that output pilot pressures that match control commands from the controller 30 and apply these pilot pressures to the pilot ports of corresponding control valves in the control valve unit are used, the actuators can be made inoperable or can be limited to run only in slow mode by disabling the control signals sent from the controller 30 to the operation proportional valves (proportional valves 31), or by outputting a deceleration command to the operation proportional valves (proportional valves 31).

Also, if the monitoring target object that is detected is a truck, the control related to stopping or deceleration of the actuators need not be exercised. For example, the actuators may be controlled so as to avoid the detected truck. In this way, the type of the detected object may be identified, and the actuators may be controlled based on what is identified.

The space recognition device 70 is configured to recognize an object that is present in the three-dimensional space around the excavator 100, and measure (calculate) the positional relationship between the space recognition device 70 or the excavator 100 and the recognized object, such as the distance therebetween. The space recognition device 70 may be, for example, an ultrasonic sensor, a millimeter wave radar, a monocular camera, a stereo camera, a LIDAR (Light Detecting and Ranging), a distance image sensor, an infrared sensor, and so forth.

With the present embodiment, the space recognition device 70 includes: a front recognition sensor 70F, which is attached to the front end of the upper surface of the cabin 10; a rear recognition sensor 70B, attached to the rear end of the upper surface of the rotating body 3; a left recognition sensor 70L, attached to the left end of the upper surface of the upper rotating body 3; and a right recognition sensor 70R, attached to the right end of the upper surface of the rotating body 3. Also, an upper recognition sensor that recognizes objects in the space above the upper rotating body 3 may be attached to the excavator 100.

The orientation detection device 71 detects information about the relative relationship between the orientation of the upper rotating body 3 and the orientation of the lower traveling body 1 (for example, the rotation angle of the upper rotating body 3 relative to the lower traveling body 1).

The orientation detection device 71 may include, for example, a combination of a ground magnetic sensor attached to the lower traveling body 1 and a ground magnetic sensor attached to the upper rotating body 3. Also, the orientation detection device 71 may include a combination of a GNSS receiver attached to the lower traveling body 1 and a GNSS receiver attached to the upper rotating body 3.

Also, the orientation detection device 71 may include a rotary encoder, a rotary position sensor, or the like that can detect the rotation angle of the upper rotating body 3 relative to the lower traveling body 1, that is, the above-mentioned rotating state sensor S5, and that may be attached to a center joint provided in association with the rotating mechanism 2 that allows relative rotation between the traveling body 1 and the upper rotating body 3.

Also, the orientation detection device 71 may include a camera that is attached to the upper rotating body 3. In this case, the orientation detection device 71 may perform existing image processing on images (input images) captured by the camera attached to the upper rotating body 3, thereby detecting images of the lower traveling body 1 included in the input images.

Then, by using existing image recognition techniques and detecting images of the lower traveling body 1, the orientation detection device 71 may specify the longitudinal direction of the lower traveling body 1, and determine the angle formed between the direction of the front-rear axis of the upper rotating body 3 and the longitudinal direction of the lower traveling body 1. At this time, the direction of the front-rear axis of the upper rotating body 3 can be determined from the position that the camera is mounted. In particular, since the crawler 1C protrudes from the upper rotating body 3, the orientation detection device 71 can identify the longitudinal direction of the lower traveling body 1 by detecting images of the crawler 1C.

Note that, in the event the upper rotating body 3 is structured to be driven rotationally by an electric motor instead of the rotary hydraulic motor 2A, a resolver may be used as the orientation detection device 71.

The input device 72 is provided within the reach of the operator seated in the cabin 10, receives various operational inputs from the operator, and outputs signals to match these operational inputs to the controller 30. For example, the input device 72 may include a touch panel that is mounted on a display of a display device that displays images of a variety of information.

Also, for example, the input device 72 may include button switches, levers, toggles, and so forth provided around the display device D1. Also, the input device 72 may include knob switches provided in the operating devices 26 (for example, a switch SW provided in the left operating lever 26L). Signals that match the details of operations made on the input device 72 are taken into the controller 30.

A switch SW is, for example, a push button switch provided at the tip of the left operating lever 26L. The operator can operate the left operating lever 26L while pressing the switch SW. The switch SW may be provided in the right operating lever 26R, or may be provided in other positions in the cabin 10.

The positioning device 73 measures the position and orientation of the upper rotating body 3. The positioning device 73 is, for example, a GNSS (Global Navigation Satellite System) compass, and detects the position and orientation of the upper rotating body 3. Detection signals corresponding to the position and orientation of the upper rotating body 3 are taken into the controller 30. Also, among the functions of the positioning device 73, the function to detect the orientation of the upper rotating body 3 may be replaced by a direction sensor attached to the upper rotating body 3.

The display device D1 is provided in a position where the operator seated in the cabin 10 can see the display device D1 with ease, and displays images of a variety of information under the control of the controller 30. The display device D1 may be connected to the controller 30 via an in-vehicle communication network such as a CAN (Controller Area Network), or may be connected to the controller 30 via a one-to-one dedicated line.

The sound output device D2 is, for example, provided in the cabin 10, connected to the controller 30, and outputs sound under the control of the controller 30. The sound output device D2 is, for example, a speaker or a buzzer. The sound output device D2 outputs a variety of information in accordance with audio output commands from the controller 30.

The boom angle sensor S1 is attached to the boom 4, and measures the elevation angle of the boom 4 (hereinafter referred to as "boom angle $\theta_1$") relative to the upper rotating body 3, such as, for example, the angle that the straight line connecting between the fulcrum points at both ends of the boom 4 forms with respect to the rotating plane of the upper rotating body 3 in side view.

The boom angle sensor S1 may include, for example, a rotary encoder, an acceleration sensor, a gyro sensor (angular velocity sensor), a 6-axis sensor, an IMU (Inertial Measurement Unit), and so forth, and, hereinafter, the same applies to an arm angle sensor S2, a bucket angle sensor S3, and a body inclination sensor S4. A detection signal from the boom angle sensor S1, corresponding to the boom angle, is taken into the controller 30.

The arm angle sensor S2 is attached to the arm 5, and measures the rotation angle of the arm 5 relative to the boom 4 (hereinafter referred to as "arm angle $\theta_2$"), such as, for example, the angle that the straight line connecting between the fulcrum points at both ends of the boom 4 forms with respect to the straight line connecting between the fulcrum points at both ends of the arm 5 in side view. A detection signal from the arm angle sensor S2, corresponding to the arm angle, is taken into the controller 30.

The bucket angle sensor S3 is attached to the bucket 6, and measures the rotation angle of the bucket 6 relative to the arm 5 (hereinafter referred to as "bucket angle $\theta_3$"), such as, for example, the angle that the straight line connecting between the fulcrum points at both ends of the arm 5 forms with respect to the straight line connecting between the fulcrum point and the tip (cutting edge) of the bucket 6 in side view. A detection signal from the bucket angle sensor S3, corresponding to the bucket angle, is taken into the controller 30.

The body inclination sensor S4 detects the tilt of the body (for example, the upper rotating body 3) with respect to the horizontal surface. The body inclination sensor S4 is, for example, attached to the upper rotating body 3, and measures the tilt angles of the excavator 100 (that is, the upper rotating body 3) about the two axes in the front-rear direction and the left-right direction (hereinafter referred to as "front-rear tilt angle" and "left-right tilt angle"). The body inclination sensor S4 may be, for example, an acceleration sensor, a gyro sensor (angular velocity sensor), a 6-axis sensor, an IMU, and so forth. A detection signal from the body inclination sensor S4, corresponding to the tilt angles (the front-rear tilt angle and the left-right tilt angle), is taken into the controller 30.

The rotating state sensor S5 is attached to the upper rotating body 3, and outputs detection information about the rotating state of the upper rotating body 3. The rotating state sensor S5 detects, for example, the rotating angular velocity and rotating angle of the upper rotating body 3. The rotating state sensor S5 may be, for example, a gyro sensor, a resolver, a rotary encoder, and the like.

In addition, if the body inclination sensor S4 includes a gyro sensor, 6-axis sensor, IMU, and the like that can detect the angular velocity about 3 axes, the rotating state (for example, the rotating angular velocity) of the upper rotating body 3 may be detected based on the detection signal from the body inclination sensor S4. In this case, the rotating state sensor S5 may be omitted.

Figure 3:
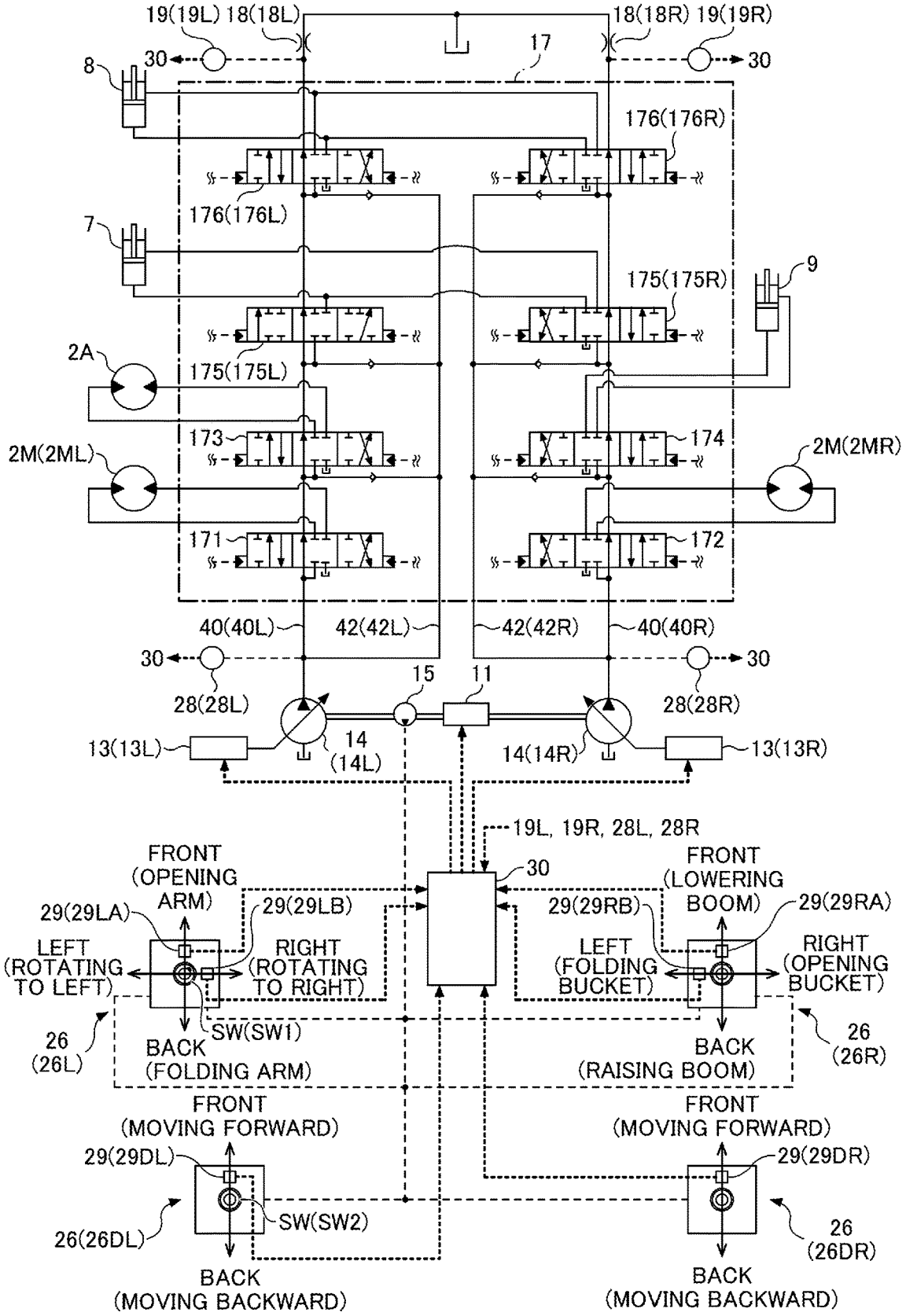
FIG. 3 is a diagram that shows an example structure of the excavator's hydraulic system.

Next, an example structure of the hydraulic system mounted in the excavator 100 will be described with reference to FIG. 3. FIG. 3 is a diagram that shows an example structure of a hydraulic system mounted in the excavator 100. FIG. 3 shows a mechanical power transmission system, hydraulic oil lines, pilot lines, and an electrical control system with double lines, solid lines, dashed lines, and dotted lines, respectively.

The hydraulic system of the excavator 100 mainly includes an engine 11, regulators 13, main pumps 14, a pilot pump 15, a control valve unit 17, operating devices 26, discharge pressure sensors 28, operation sensors 29, controller 30, and so forth.

In FIG. 3, the hydraulic system is structured such that hydraulic oil can be circulated from the main pumps 14 driven by the engine 11, to a hydraulic oil tank, via center bypass pipelines 40 or parallel pipelines 42.

The engine 11 is the drive source for the excavator 100. With the present embodiment, the engine 11 is, for example, a diesel engine that runs by maintaining a predetermined number of rotations per unit time. The output shaft of the engine 11 is connected to the input shafts of the main pumps 14 and the pilot pump 15.

The main pumps 14 are structured to supply hydraulic oil to the control valve unit 17 via hydraulic oil lines. With the present embodiment, the main pumps 14 are swash-plate variable displacement hydraulic pumps.

The regulators 13 are structured to control the amount of discharge by the main pumps 14. With the present embodiment, the regulators 13 control the amount of discharge by the main pumps 14 by adjusting the tilting angle of the swashplates of the main pumps 14 in accordance with control commands from the controller 30.

The pilot pump 15 is an example of a pilot pressure generating device, and is structured to supply hydraulic oil to the hydraulic control equipment via pilot lines. With the present embodiment, the pilot pump 15 is a fixed displacement hydraulic pump. However, the pilot pressure generating device may be implemented by the main pumps 14.

That is, the main pumps 14 may have a function to supply hydraulic oil to various types of hydraulic control equipment via pilot lines, in addition to the function to supply hydraulic oil to the control valve unit 17 via hydraulic oil lines. In this case, the pilot pump 15 may be omitted.

The control valve unit 17 is a hydraulic controller that controls the hydraulic system in the excavator 100. With the present embodiment, the control valve unit 17 includes control valves 171 to 176. The control valves 175 include a control valve 175L and a control valve 175R, and the control valves 176 include a control valve 176L and a control valve 176R. The control valve unit 17 is structured such that the hydraulic oil discharged by the main pumps 14 can be selectively supplied to one or more hydraulic actuators through the control valves 171 to 176.

The control valves 171 to 176 control, for example, the flow rate of hydraulic oil from the main pumps 14 to the hydraulic actuators and the flow rate of hydraulic oil from the hydraulic actuators to the hydraulic oil tank. The hydraulic actuators include a boom cylinder 7, an arm cylinder 8, a bucket cylinder 9, drive hydraulic motors 2M, and a rotary hydraulic motor 2A. The drive hydraulic motors 2M include a left drive hydraulic motor 2ML and a right drive hydraulic motor 2MR.

The operating devices 26 are structured to allow the operator to operate the actuators. With the present embodiment, the operating devices 26 include a hydraulic actuator operating device that is structured to allow the operator to operate the hydraulic actuators.

To be more specific, the hydraulic actuator operating device is structured such that the hydraulic oil discharged from the pilot pump 15 can be supplied to the pilot ports of corresponding control valves in the control valve unit 17 via the pilot line. The pressure (pilot pressure) of hydraulic oil supplied to each pilot port is adjusted to be suitable for each individual hydraulic actuator, depending on the direction of operation and the amount of operation made on the operating devices 26 with respect to each hydraulic actuator.

The discharge pressure sensors 28 are structured to detect the discharge pressure of the main pumps 14. With the present embodiment, the discharge pressure sensors 28 output the detected values to the controller 30.

The operation sensors 29 are structured to detect the details of operations made on the operating devices 26 by the operator. With the present embodiment, the operation sensors 29 detect the direction of operation and the amount of operation made on the operating devices 26 for each corresponding actuator, and output the detected values to the controller 30.

The main pumps 14 include a left main pump 14L and a right main pump 14R. The left main pump 14L circulates the hydraulic oil through a left center bypass pipeline 40L or a left parallel pipeline 42L to the hydraulic oil tank, and the right main pump 14R circulates the hydraulic oil through a right center bypass pipeline 40R or a right parallel pipeline 42R to the hydraulic oil tank.

The left center bypass pipeline 40L is a hydraulic oil line that passes through the control valves 171, 173, 175L, and 176L positioned in the control valve unit 17. The right center bypass pipeline 40R is a hydraulic oil line that passes through the control valves 172, 174, 175R, and 176R positioned in the control valve unit 17.

The control valve 171 is a spool valve that switches the flow of hydraulic oil such that the hydraulic oil discharged from the left main pump 14L is supplied to the left drive hydraulic motor 2ML, and the hydraulic oil discharged from the left drive hydraulic motor 2ML is sent to the hydraulic oil tank.

The control valve 172 is a spool valve that switches the flow of hydraulic oil such that the hydraulic oil discharged from the right main pump 14R is supplied to the right drive hydraulic motor 2MR, and the hydraulic oil discharged from the right drive hydraulic motor 2MR is sent to the hydraulic oil tank.

The control valve 173 is a spool valve that switches the flow of hydraulic oil such that the hydraulic oil discharged from the left main pump 14L is supplied to the rotary hydraulic motor 2A, and the hydraulic oil discharged from the rotary hydraulic motor 2A is sent to the hydraulic oil tank.

The control valve 174 is a spool valve that switches the flow of hydraulic oil such that the hydraulic oil discharged from the right main pump 14R is supplied to the bucket cylinder 9, and the hydraulic oil in the bucket cylinder 9 is sent to the hydraulic oil tank.

The control valve 175L is a spool valve that switches the flow of hydraulic oil to supply the hydraulic oil discharged from the left main pump 14L to the boom cylinder 7. The control valve 175R is a spool valve that switches the flow of hydraulic oil such that the hydraulic oil discharged from the right main pump 14R is supplied to the boom cylinder 7, and the hydraulic oil in the boom cylinder 7 is sent to the hydraulic oil tank.

The control valve 176L is a spool valve that switches the flow of hydraulic oil such that the hydraulic oil discharged from the left main pump 14L is supplied to the arm cylinder 8, and the hydraulic oil in the arm cylinder 8 is sent to the hydraulic oil tank.

The control valve 176R is a spool valve that switches the flow of hydraulic oil such that the hydraulic oil discharged from the right main pump 14R is supplied to the arm cylinder 8, and the hydraulic oil in the arm cylinder 8 is sent to the hydraulic oil tank.

The left parallel pipeline 42L is a hydraulic oil line that runs parallel to the left center bypass pipeline 40L. When the flow of hydraulic oil passing through the left center bypass pipeline 40L is limited or blocked by any of the control valves 171, 173, and 175L, the left parallel pipeline 42L can supply hydraulic oil to a more downstream control valve.

The right parallel pipeline 42R is a hydraulic oil line that runs parallel to the right center bypass pipeline 40R. When the flow of hydraulic oil passing through the right center bypass pipeline 40R is limited or blocked by any of the control valves 172, 174, and 175R, the right parallel pipeline 42R can supply hydraulic oil to a more downstream control valve.

The regulators 13 include a left regulator 13L and a right regulator 13R. The left regulator 13L controls the amount of discharge by the left main pump 14L by adjusting the tilting angle of the swashplate of the left main pump 14L according to the discharge pressure of the left main pump 14L. To be more specific, the left regulator 13L reduces the amount of discharge by the left main pump 14L by adjusting the tilting angle of the swashplate of the left main pump 14L in accordance with an increase in the discharge pressure of the left main pump 14L, for example. The same applies to the right regulator 13R. This is to prevent the suction power (absorption horse power) of the main pumps 14, which is given by the product of the discharge pressure and the amount of discharge, from exceeding the output power (output horse power) of the engine 11.

The operating devices 26 include a left operating lever 26L, a right operating lever 26R, and a drive lever 26D. The drive lever 26D includes a left drive lever 26DL and a right drive lever 26DR.

The left operating lever 26L is used for rotating operation and operating the arm 5. When the left operating lever 26L is operated in the front-rear direction, a control pressure to match the amount of the lever operation is introduced to the pilot port of the control valve 176 by using the hydraulic oil discharged by the pilot pump 15. Also, when the left operating lever 26L is operated in the left-right direction, a control pressure to match the amount of the lever operation is introduced to the pilot port of the control valve 173 by using the hydraulic oil discharged from the pilot pump 15.

To be more specific, when the left operating lever 26L is operated in the arm-folding direction, hydraulic oil is introduced to the right pilot port of the control valve 176L and to the left pilot port of the control valve 176R. Also, when the left operating lever 26L is operated in the arm-opening direction, hydraulic oil is introduced to the left pilot port of the control valve 176L, and to the right pilot port of the control valve 176R. Also, when the left operating lever 26L is operated in the left-rotating direction, the hydraulic oil is introduced to the left pilot port of the control valve 173. When the left operating lever 26L is operated in the right-rotating direction, the hydraulic oil is introduced to the right pilot port of control valve 173.

The right operating lever 26R is used to operate the boom 4 and the bucket 6. When the right operating lever 26R is operated in the front-rear direction, a control pressure to match the amount of the lever operation is introduced to the pilot port of the control valve 175 by using the hydraulic oil discharged by the pilot pump 15. Also, when the right operating lever 26R is operated in the left-right direction, a control pressure to match the amount of the lever operation is introduced to the pilot port of the control valve 174 by using the hydraulic oil discharged from the pilot pump 15.

To be more specific, when the right operating lever 26R is operated in the boom-lowering direction, hydraulic oil is introduced to the left pilot port of the control valve 175R. Also, when the right operating lever 26R is operated in the boom-raising direction, hydraulic oil is introduced to the right pilot port of the control valve 175L and to the left pilot port of the control valve 175R. Also, when the right operating lever 26R is operated in the bucket-folding direction, hydraulic oil is introduced to the right pilot port of the control valve 174. When the right operating lever 26R is operated in the bucket-opening direction, hydraulic oil is introduced to the left pilot port of the control valve 174.

In the following description, the left operating lever 26L that is operated in the left-right direction may be referred to as a "rotation operating lever," and the left operating lever 26L that is operated in the front-rear direction may be referred to as an "arm operating lever." Also, the right operating lever 26R that is operated in the left-right direction may be referred to as a "bucket operating lever," and the right operating lever 26R that is operated in the front-rear direction may be referred to as a "boom-operating lever."

The drive lever 26D is used to operate a crawler 1C. To be more specific, the left drive lever 26DL is used to operate the left crawler 1CL. The left drive lever 26DL may also be structured to work in conjunction with the left drive pedal.

When the left drive lever 26DL is operated in the front-rear direction, a control pressure to match the amount of the lever operation is introduced to the pilot port of the control valve 171 by using the hydraulic oil discharged by the pilot pump 15. The right drive lever 26DR is used to operate a right crawler 1CR. The right drive lever 26DR may also be structured to work in conjunction with the right drive pedal. When the right drive lever 26DR is operated in the front-rear direction, a control pressure to match the amount of the lever operation is introduced to the pilot port of the control valve 172 by using the hydraulic oil discharged by the pilot pump 15.

The discharge pressure sensors 28 include a discharge pressure sensor 28L and a discharge pressure sensor 28R. The discharge pressure sensor 28L detects the discharge pressure of the left main pump 14L, and outputs the detected value to the controller 30. The same applies to the discharge pressure sensor 28R.

The operation sensors 29 include operation sensors 29LA, 29LB, 29RA, 29RB, 29DL, and 29DR. The operation sensor 29LA detects the details of operation that the operator performs on the left operating lever 26L in the front-rear direction, and outputs the detected values to the controller 30. The details of operation include, for example, the direction of lever operation, the amount of lever operation (the angle of lever operation), and the like.

Similarly, the operation sensor 29LB detects the details of operation that the operator performs on the left operating lever 26L in the left-right direction, and outputs the detected values to the controller 30. The operation sensor 29RA detects the details of operation that the operator performs on the right operating lever 26R in the front-rear direction, and outputs the detected values to the controller 30.

The operation sensor 29RB detects the details of operation that the operator performs on the right operating lever 26R in the left-right direction, and outputs the detected values to the controller 30. The operation sensor 29DL detects the details of operation that the operator performs on the left operating lever 26DL in the front-rear direction, and outputs the detected values to the controller 30. The operation sensor 29DR detects the details of operation that the operator performs on the right operating lever 26DR in the front-rear direction, and outputs the detected values to the controller 30.

The controller 30 receives the outputs of the operation sensors 29, outputs control commands to the regulators 13 on an as-needed basis, and changes the amount of discharge by the main pumps 14. Also, the controller 30 receives the outputs of control pressure sensors 19 provided upstream of the restrictors 18, outputs control commands to the regulators 13 on an as-needed basis, and changes the amount of discharge by the main pumps 14. The restrictors 18 include a left restrictor 18L and a right restrictor 18R, and the control pressure sensors 19 include a left control pressure sensor 19L and a right control pressure sensor 19R.

In the left center bypass pipeline 40L, the left restrictor 18L is positioned between the most downstream control valve 176L and the hydraulic oil tank. Consequently, the flow of hydraulic oil discharged from the left main pump 14L is limited by the left restrictor 18L. The left restrictor 18L generates a control pressure for controlling the left regulator 13L.

The left control pressure sensor 19L is a sensor for detecting this control pressure, and outputs the detected value to the controller 30. The controller 30 controls the amount of discharge by the left main pump 14L by adjusting the tilting angle of the swashplate of the left main pump 14L in accordance with this control pressure. The controller 30 decreases the amount of discharge by the left main pump 14L when this control pressure increases, and increases the amount of discharge by the left main pump 14L when the control pressure decreases. The amount of discharge by the right main pump 14R is controlled likewise.

To be more specific, as shown in FIG. 3, in a standby state in which none of the hydraulic actuators in the excavator 100 is operated, hydraulic oil discharged from the left main pump 14L passes through the left center bypass pipeline 40L and reaches the left restrictor 18L. Then, the flow of hydraulic oil discharged from the left main pump 14L increases the control pressure produced upstream of the left restrictor 18L. As a result of this, the controller 30 reduces the amount of discharge by the left main pump 14L to the minimum possible amount of discharge, and reduces the pressure loss (pumping loss) that is produced when the discharged hydraulic oil passes through left center bypass pipeline 40L.

On the other hand, when one of the hydraulic actuators is operated, the hydraulic oil discharged from the left main pump 14L flows into the hydraulic actuator that is operated, via a control valve corresponding to the hydraulic actuator that is operated. Then, due to the flow of hydraulic oil discharged from the left main pump 14L, the amount of hydraulic oil to reach the left restrictor 18L decreases or vanishes, thus lowering the control pressure that is produced upstream of the left restrictor 18L.

As a result of this, the controller 30 increases the amount of discharge by the left main pump 14L, circulates a sufficient amount of hydraulic oil in the hydraulic actuator that is operated, and ensures that the hydraulic actuator that is operated works. Note that the controller 30 likewise controls the amount of discharge by the right main pump 14R.

With the above-described structure, the hydraulic system shown in FIG. 3 can reduce the wasteful energy consumption in the main pumps 14 while in the standby state. The wasteful energy consumption includes the pumping loss that the hydraulic oil discharged from the main pumps 14 causes in the center bypass pipeline 40. Also, when starting a hydraulic actuator, the hydraulic system shown in FIG. 3 can reliably supply necessary and sufficient hydraulic oil from the main pumps 14 to the hydraulic actuator to be started.

Figure 4A:
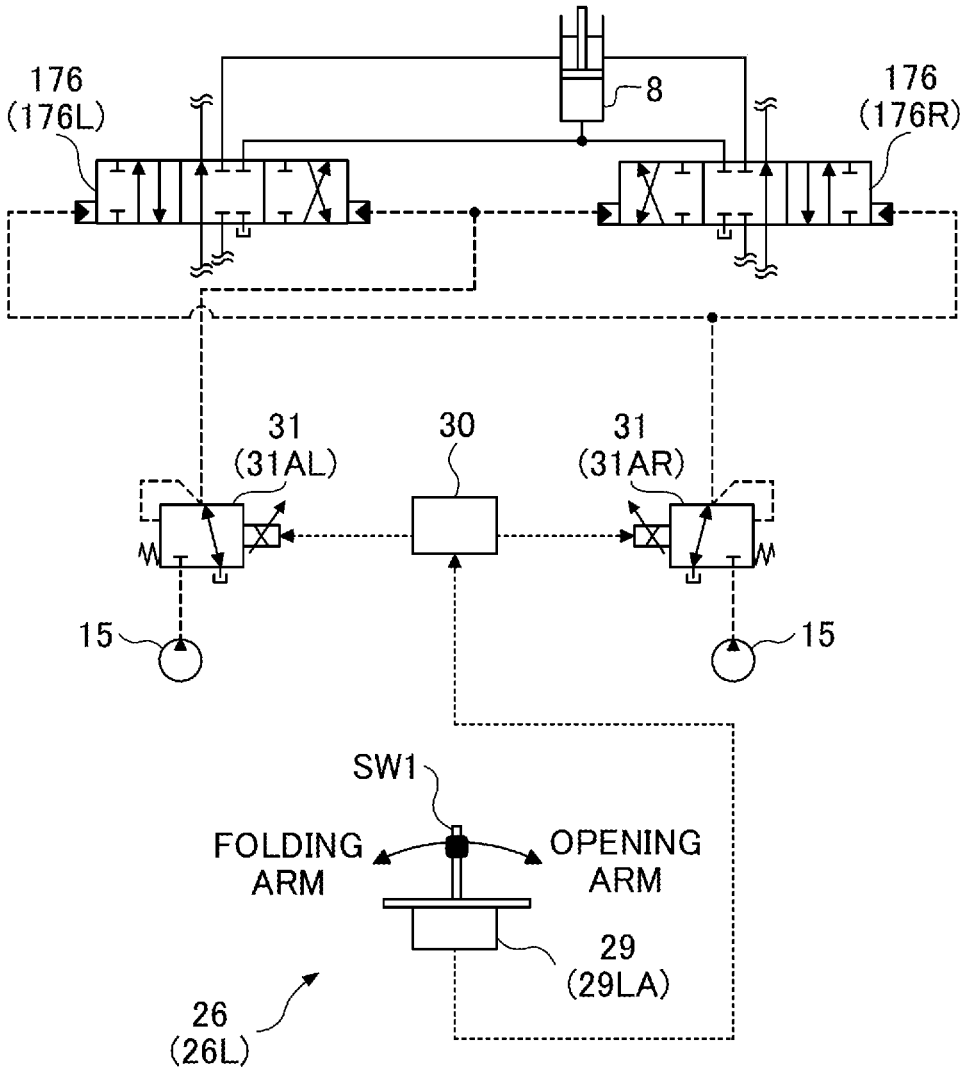
FIG. 4A is a diagram that extracts a part in the hydraulic system that relates to operation of an arm cylinder.
Figure 4B:
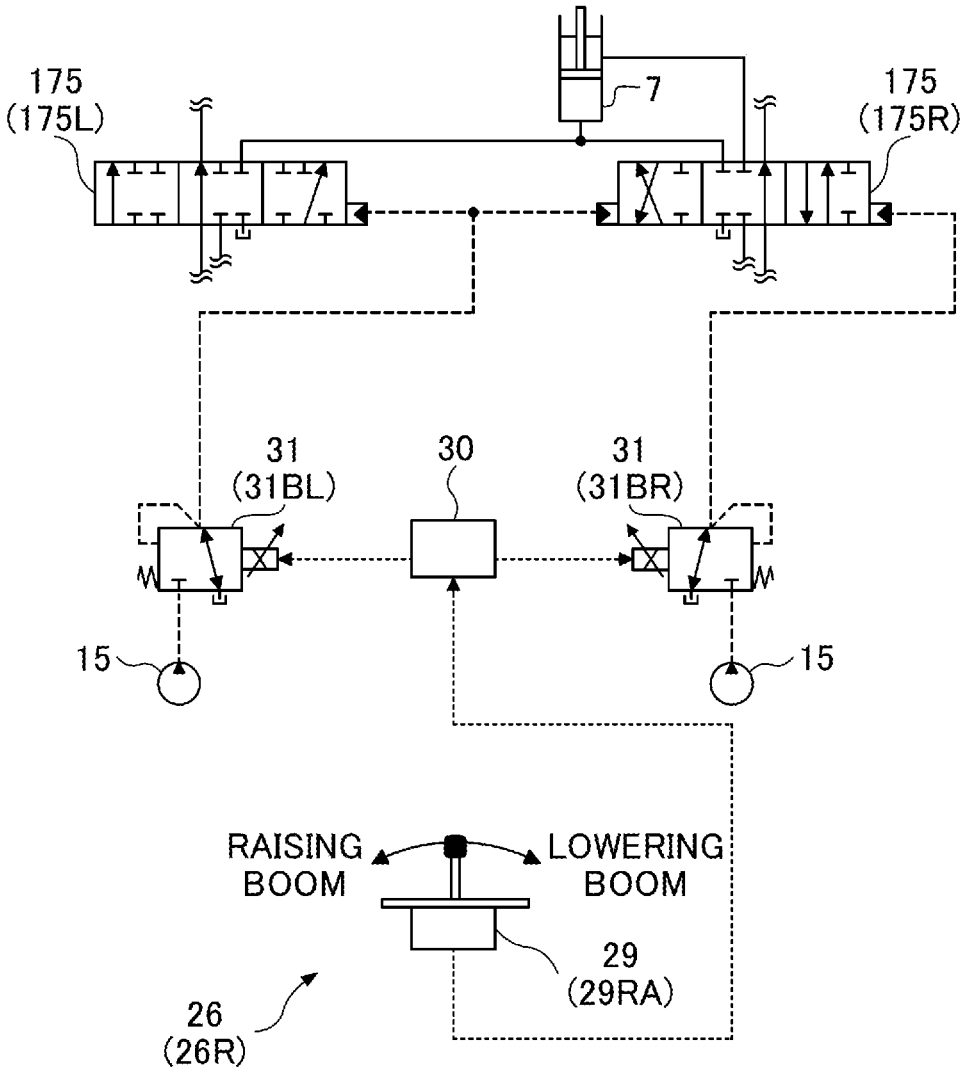
FIG. 4B is a diagram that extracts a part in the hydraulic system that relates to operation of a boom cylinder.
Figure 4C:
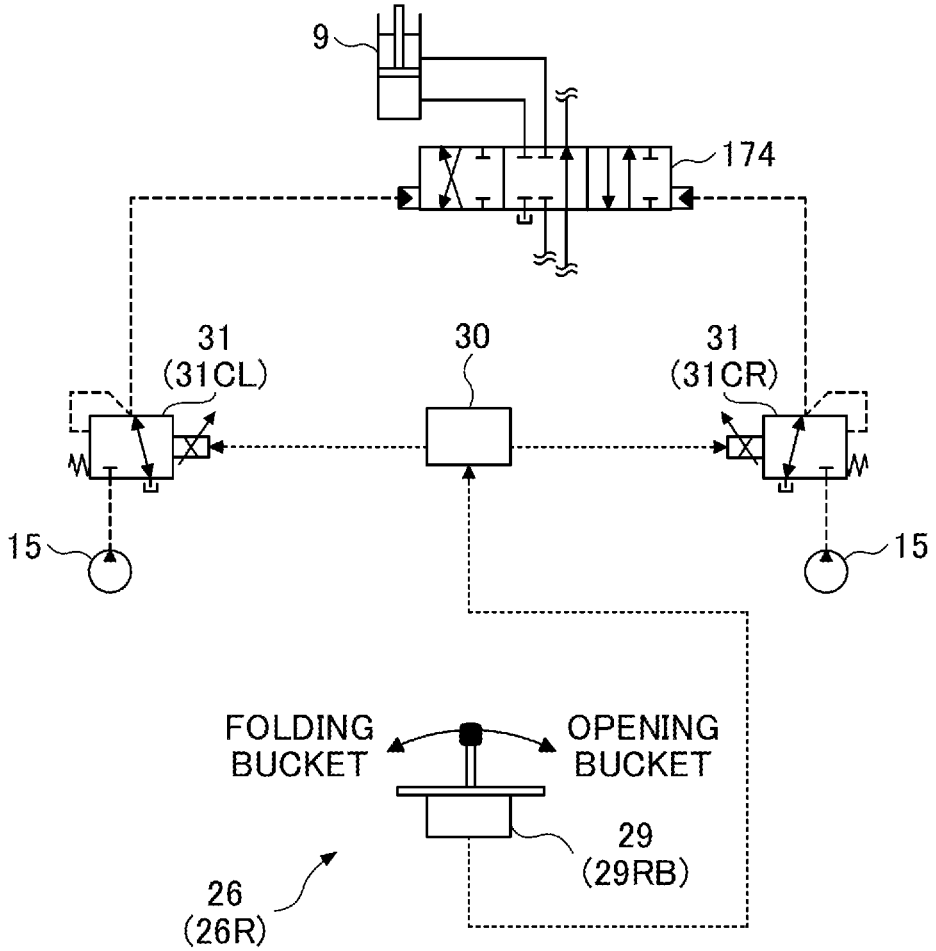
FIG. 4C is a diagram that extracts a part in the hydraulic system that relates to operation of a bucket cylinder.
Figure 4D:
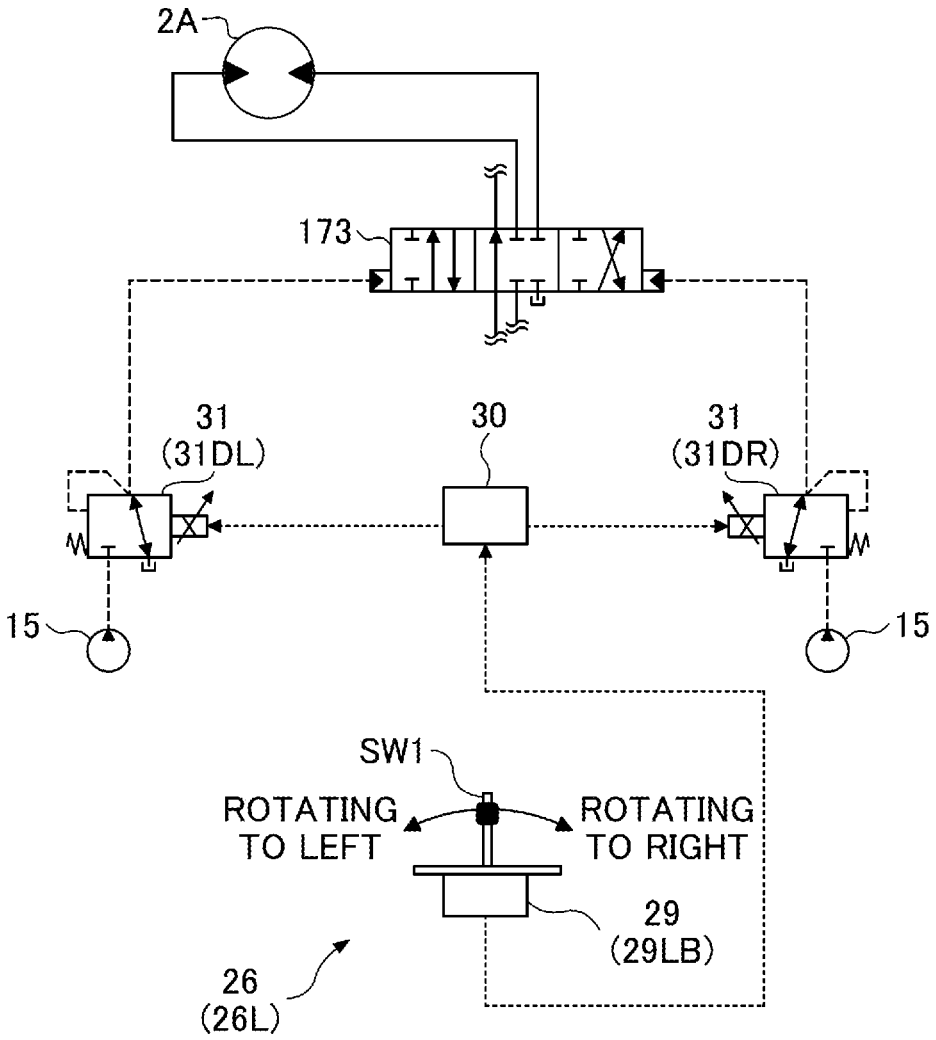
FIG. 4D is a diagram that extracts a part in the hydraulic system that relates to operation of a rotary hydraulic motor.

Next, a structure for allowing the controller 30 to run the actuators by using a machine control function will be described with reference to FIG. 4A to FIG. 4D. FIG. 4A to FIG. 4D are each a diagram extracting a part of the hydraulic system. To be more specific, FIG. 4A is a diagram that extracts a part in the hydraulic system that relates to operation of the arm cylinder 8, and FIG. 4B is a diagram that extracts a part in the hydraulic system that relates to operation of the boom cylinder 7. FIG. 4C is a diagram that extracts a part in the hydraulic system that relates to operation of the bucket cylinder 9, and FIG. 4D is a diagram that extracts a part in the hydraulic system that relates to operation of the rotary hydraulic motor 2A.

As shown in FIG. 4A to FIG. 4D, the hydraulic system includes a proportional valves 31. The proportional valves 31 include proportional valves 31AL to 31DL and 31AR to 31DR.

The proportional valves 31 function as control valves for machine control. The proportional valves 31 are positioned in pipelines connecting the pilot pumps 15 and the pilot ports of corresponding control valves in the control valve unit 17, and structured such that the flow area of the pipelines can be changed.

With the present embodiment, the proportional valves 31 work in accordance with control commands from the controller 30. Consequently, regardless of operations that the operator performs on the operating devices 26, the controller 30 can supply the hydraulic oil discharged by the pilot pumps 15, to the pilot ports of the corresponding control valves in the control valve unit 17, via the proportional valves 31. Then, the controller 30 can make the pilot pressures produced by the proportional valves 31 act on the pilot ports of the corresponding control valves.

By means of this structure, even when a specific operating device 26 is not being operated, the controller 30 can still run the hydraulic actuator corresponding to that specific operating device 26. Also, even when a specific operating device 26 is being operated, the controller 30 can force the movement of the hydraulic actuator corresponding to that specific operating device 26 to a stop.

For example, as shown in FIG. 4A, the left operating lever 26L is used to operate the arm 5. To be more specific, the left operating lever 26L applies a pilot pressure to match the operation of the left operating lever 26L in the front-rear direction, to pilot ports of the control valves 176, by using the hydraulic oil discharged by the pilot pumps 15. To be more specific, when the left operating lever 26L is operated in the direction to fold the arm (rear direction), a pilot pressure to match the amount of the operation is applied to the right pilot port of the control valve 176L and the left pilot port of the control valve 176R. Also, when the left operating lever 26L is operated in the direction to open the arm (forward direction), a pilot pressure to match the amount of the operation is applied to the left pilot port of the control valve 176L and the right pilot port of the control valve 176R.

The operating devices 26 are provided with switches SW. With the present embodiment, the switches SW include a switch SW1 and a switch SW2.

The switch SW1 is a push button switch provided at the tip of the left operating lever 26L. The operator can operate the left operating lever 26L while pressing the switch SW1. The switch SW1 may be provided in the right operating lever 26R, or may be provided in other positions in the cabin 10.

The switch SW2 is a push button switch provided at the tip of the left drive lever 26DL. The operator can operate the left drive lever 26DL while pressing the switch SW2. The switch SW2 may be provided in the right drive lever 26DR, or may be provided in other positions in the cabin 10.

The operation sensor 29LA detects the details of operation that the operator performs on the left operating lever 26L in the front-rear direction, and outputs the detected values to the controller 30.

The proportional valve 31AL works in accordance with control commands (current commands) output by the controller 30. Then, the proportional valve 31AL adjusts the pilot pressures caused by the hydraulic oil introduced from the pilot pumps 15 to the right pilot port of the control valve 176L and to the left pilot port of the control valve 176R via the proportional valve 31AL.

The proportional valve 31AR works in accordance with control commands (current commands) output by the controller 30. Then, the proportional valve 31AR adjusts the pilot pressures caused by the hydraulic oil introduced from the pilot pumps 15 to the left pilot port of the control valve 176L and to the right pilot port of the control valve 176R via the proportional valve 31AR. the proportional valve 31AL can adjust the pilot pressures such that the control valve 176L and the control valve 176R can be stopped at any valve positions. Similarly, the proportional valve 31AR can adjust the pilot pressures such that the control valve 176L and the control valve 176R can be stopped at any valve positions.

By means of this structure, the controller 30 can supply the hydraulic oil discharged by the pilot pump 15 to the right pilot port of the control valve 176L and to the left pilot port of the control valve 176R, via the proportional valve 31AL, in accordance with arm-folding operations by the operator. Also, regardless of arm-folding operations by the operator, the controller 30 can supply the hydraulic oil discharged by the pilot pump 15 to the right pilot port of the control valve 176L and to the left pilot port of the control valve 176R via the proportional valve 31AL. That is, the controller 30 can fold the arm 5 in accordance with arm-folding operations by the operator or independently of arm-folding operations by the operator.

Also, the controller 30 can supply the hydraulic oil discharged by the pilot pump 15 to the left pilot port of the control valve 176L and to the right pilot port of the control valve 176R, via the proportional valve 31AR, in accordance with arm-opening operations by the operator. Also, regardless of arm-opening operations by the operator, the controller 30 can supply the hydraulic oil discharged by the pilot pump 15 to the left pilot port of the control valve 176L and to the right pilot port of the control valve 176R, via the proportional valve 31AR. That is, the controller 30 can open the arm 5 in accordance with arm-opening operations by the operator or independently of arm-opening operations by the operator.

Also, with this structure, even when the operator is performing an arm-folding operation, the controller 30 can reduce the pilot pressures that act on the closing-side pilot ports of the control valves 176 (the left pilot port of the control valve 176L and the control valve 176R) on an as-needed basis, and force the folding movement of the arm 5 to a stop. The same applies to the case in which the opening movement of the arm 5 is forced to a stop while the operator is performing an arm-opening operation.

Alternatively, even when the operator is performing an arm-folding operation, the controller 30 may, if necessary, control the proportional valve 31AR, increase the pilot pressures that act on the opening-side pilot ports of the control valves 176 (the right pilot port of the control valve 176L and the left pilot port of the control valve 176R), which are provided on the opposite side of the closing-side pilot ports of the control valves 176, and force the control valves 176 back to neutral positions, such that the folding movement of the arm 5 is forced to a stop. The same applies to the case in which the opening movement of the arm 5 is forced to a stop while the operator is performing an arm-opening operation.

Although not described below with reference to FIG. 4B to FIG. 4D, the same applies when the movement of the boom 4 is forced to a stop while the operator is performing a boom-raising operation or a boom-lowering operation, when the movement of the bucket 6 is forced to a stop while the operator is performing a bucket-folding or a bucket-opening operation, and when the rotating movement of the upper rotating body 3 is forced to a stop while the operator is performing a rotating operation. Furthermore, the same applies when the traveling movement of the lower traveling body 1 is forced to a stop while the operator is performing a traveling operation.

Also, as shown in FIG. 4B, the right operating lever 26R is used to operate the boom 4. To be more specific, using the hydraulic oil discharged by the pilot pump 15, the right operating lever 26R applies pilot pressures to the pilot ports of the control valves 175 in accordance with the operation of the right operating lever 26R in the front-rear direction. To be more specific, when the right operating lever 26R is operated in a direction to raise the boom 4 (rear direction), a pilot pressure to match the amount of the operation is applied to the right pilot port of the control valve 175L and to the left pilot port of the control valve 175R. Likewise, when the right operating lever 26R is operated in a direction to lower the boom 4 (forward direction), a pilot pressure to match the amount of the operation is applied to the right pilot port of the control valve 175R.

The operation sensor 29RA detects the details of operations that the operator performs on the right operating lever 26R in the front-rear direction, and outputs the detected values to the controller 30.

The proportional valve 31BL works in accordance with control commands (current commands) output from the controller 30. Then, the proportional valve 31BL adjusts the pilot pressures produced by the hydraulic oil that is introduced from the pilot pump 15 to the right pilot port of the control valve 175L and to the left pilot port of the control valve 175R via the proportional valve 31BL. The proportional valve 31BR works in accordance with control commands (current commands) from the controller 30.

Then, the proportional valve 31BR adjusts the pilot pressure produced by the hydraulic oil that is introduced from the pilot pump 15 to the right pilot port of the control valve 175R via the proportional valve 31BR. The proportional valve 31BL can adjust the pilot pressure such that the control valve 175L and the control valve 175R can be stopped at any valve positions. Also, the proportional valve 31BR can adjust the pilot pressure such that the control valve 175R can be stopped at any valve position.

Given this structure, the controller 30 can supply the hydraulic oil discharged by the pilot pump 15 to the right pilot port of the control valve 175L and to the left pilot port of the control valve 175R, via the proportional valve 31BL, in accordance with boom-raising operations by the operator. Also, regardless of boom-raising operations by the operator, the controller 30 can supply the hydraulic oil discharged by the pilot pump 15 to the right pilot port of the control valve 175L and to the left pilot port of the control valve 175R, via the proportional valve 31BL. That is, the controller 30 can raise the boom 4 in accordance with boom-raising operations by the operator or independently of boom-raising operations by the operator.

Also, the controller 30 can supply the hydraulic oil discharged by the pilot pump 15 to the right pilot port of the control valve 175R, via the proportional valve 31BR, in accordance with boom-lowering operations by the operator. Also, the controller 30 can supply the hydraulic oil discharged by the pilot pump 15 to the right pilot port of the control valve 175R, via the proportional valve 31BR, regardless of boom-lowering operations by the operator.

That is, the controller 30 can lower the boom 4 in accordance with boom-lowering operations by the operator or independently of boom-lowering operations by the operator.

Furthermore, as shown in FIG. 4C, the right operating lever 26R is also used to operate the bucket 6. To be more specific, using the hydraulic oil discharged by the pilot pump 15, the right operating lever 26R applies pilot pressures to the pilot ports of a control valve 174 in accordance with operations that the operator performs in the left-right direction.

To be more specific, when the right operating lever 26R is operated in a direction to close the bucket (left direction), a pilot pressure to match the amount of the operation is applied to the left pilot port of the control valve 174. Also, when the right operating lever 26R is operated in a direction to open the bucket (right direction), a pilot pressure to match the amount of the operation is applied to the right pilot port of the control valve 174.

The operation sensor 29RB detects the details of operations that the operator performs on the right operating lever 26R in the left-right direction, and outputs the detected values to the controller 30.

The proportional valve 31CL works in accordance with control commands (current commands) from the controller 30. Then, the proportional valve 31CL adjusts the pilot pressure produced by the hydraulic oil that is introduced from the pilot pump 15 to the left pilot port of the control valve 174 via the proportional valve 31CL. The proportional valve 31CR works in accordance with control commands (current commands) from the controller 30.

Then, the proportional valve 31BR adjusts the pilot pressure produced by the hydraulic oil that is introduced from the pilot pump 15 to the right pilot port of the control valve 174 via the proportional valve 31CR. The proportional valve 31CL can adjust the pilot pressure such that the control valve 174 can be stopped at any valve position. Similarly, the proportional valve 31CR can adjust the pilot pressure such that the control valve 174 can be stopped at any valve position.

Given this structure, the controller 30 can supply the hydraulic oil discharged by the pilot pump 15 to the left pilot port of the control valve 174, via the proportional valve 31CL, in accordance with bucket-folding operations by the operator. Also, regardless of bucket-folding operations by the operator, the controller 30 can supply the hydraulic oil discharged by the pilot pump 15 to the left pilot port of the control valve 174 via the proportional valve 31CL. That is, the controller 30 can close the bucket 6 in accordance with bucket-folding operations by the operator or independently of bucket-folding operations by the operator.

Also, the controller 30 can supply the hydraulic oil discharged by the pilot pump 15 to the right pilot port of the control valve 174, via the proportional valve 31CR, in accordance with bucket-opening operations by the operator. Also, the controller 30 can supply the hydraulic oil discharged by the pilot pump 15 to the right pilot port of the control valve 174, via the proportional valve 31CR, independently of bucket-opening operations by the operator. That is, the controller 30 can open the bucket 6 in accordance with bucket-opening operations by the operator or independently of bucket-opening operations by the operator.

Also, as shown in FIG. 4D, the left operating lever 26L is also used to operate the rotating mechanism 2. To be more specific, using the hydraulic oil discharged by the pilot pump 15, the left operating lever 26L applies pilot pressures to the pilot ports of a control valve 173 in accordance with operations made in the left-right direction.

To be more specific, when the left operating lever 26L is operated in the left-rotation direction (left direction), a pilot pressure to match the amount of the operation is applied to the left pilot port of the control valve 173. Also, when the left operating lever 26L is operated in the right-rotation direction (right direction), a pilot pressure to match the amount of the operation is applied to the left pilot port of the control valve 173.

The operation sensor 29LB detects the details of operation that the operator performs on the left operating lever 26L in the left-right direction, and outputs the detected values to the controller 30.

The proportional valve 31DL works in accordance with control commands (current commands) from the controller 30. Then, the proportional valve 31DL adjusts the pilot pressure produced by the hydraulic oil that is introduced from the pilot pump 15 to the left pilot port of the control valve 173 via the proportional valve 31DL. The proportional valve 31DR works in accordance with control commands (current commands) from the controller 30.

Then, the proportional valve 31DR adjusts the pilot pressure produced by the hydraulic oil that is introduced from the pilot pump 15 to the right pilot port of the control valve 173 via the proportional valve 31DR. The proportional valve 31DL can adjust the pilot pressure such that the control valve 173 can be stopped at any valve position. Similarly, the proportional valve 31DR can adjust the pilot pressure such that the control valve 173 can be stopped at any valve position.

Given this structure, the controller 30 can supply the hydraulic oil discharged by the pilot pump 15 to the left pilot port of the control valve 173, via the proportional valve 31DL, in accordance with left-rotating operations by the operator. Also, the controller 30 can supply the hydraulic oil discharged by the pilot pump 15 to the left pilot port of the control valve 173, via the proportional valve 31DL, independently of left-rotating operations by the operator. That is, the controller 30 can rotate the rotating mechanism 2 to the left in accordance with left-rotating operations by the operator or independently of left-rotating operations by the operator.

Also, the controller 30 can supply the hydraulic oil discharged by the pilot pump 15 to the right pilot port of the control valve 173, via the proportional valve 31DR, in accordance with right-rotating operations by the operator. Also, the controller 30 can supply the hydraulic oil discharged by the pilot pump 15 to the right pilot port of the control valve 173, via the proportional valve 31DR, independently of right-rotating operations by the operator. That is, the controller 30 can rotate the rotating mechanism 2 to the right in accordance with right-rotating operations by the operator or independently of right-rotating operations by the operator.

Figure 5:
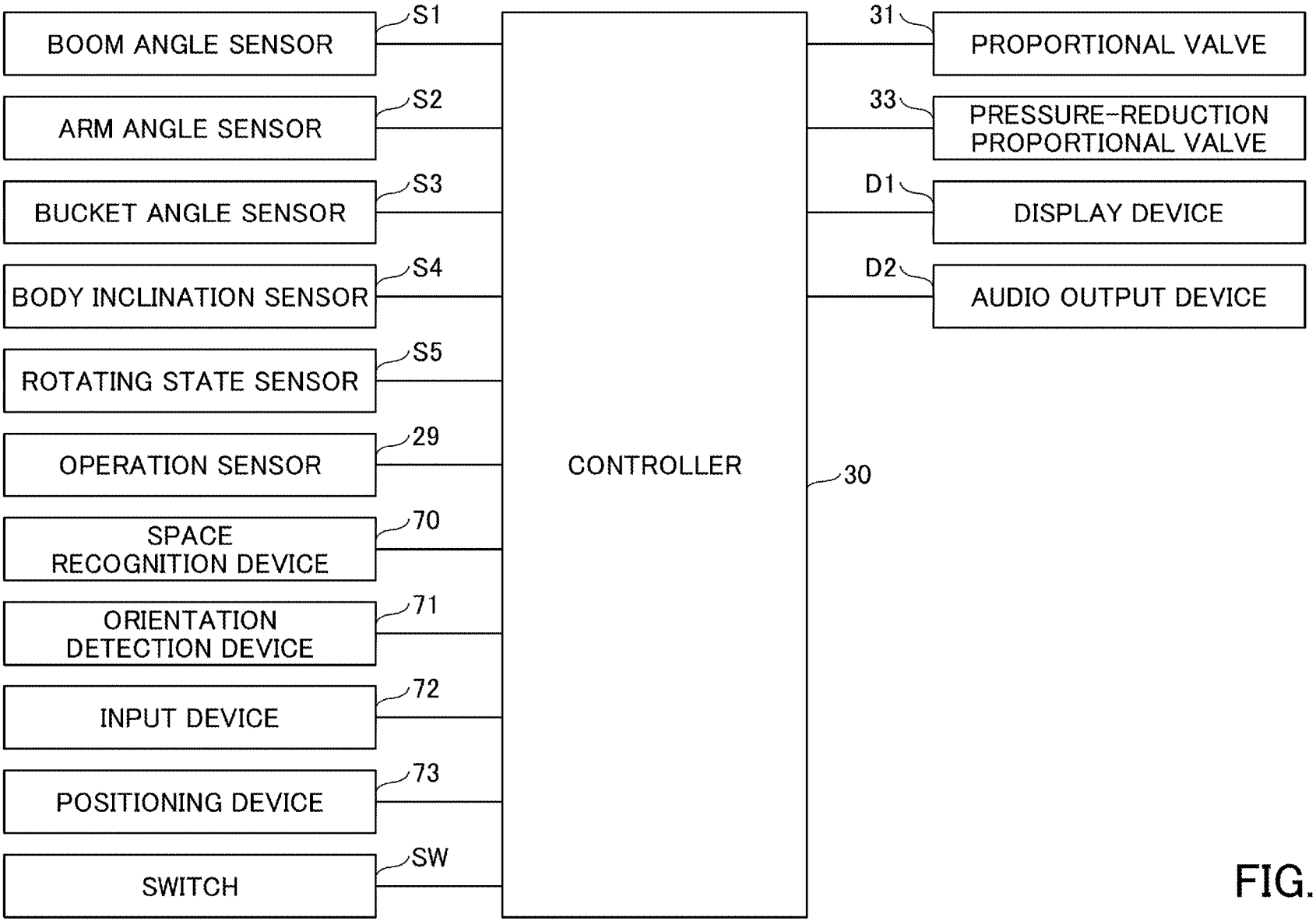
FIG. 5 is a block diagram that shows an example structure related to a machine guidance function and a machine control function of the excavator.

Next, the machine guidance function and machine control function of the excavator 100 will be described with reference to FIG. 5. FIG. 5 is a block diagram that shows an example structure related to the machine guidance function and machine control function of the excavator.

The controller 30 exercises control over the excavator 100 with respect to the machine guidance function that, for example, guides the operator's manual operations of the excavator 100.

The controller 30 sends work information such as the distance between the target working surface and the tip of the attachment AT, or, to be more specific, the working part of the end attachment, to the operator, through the display device D1, sound output device D2, and so forth.

To be more specific, the controller 30 acquires information from the boom angle sensor S1, arm angle sensor S2, bucket angle sensor S3, body inclination sensor S4, rotating state sensor S5, space recognition device 70, positioning device 73, input device 72, and so forth.

Data about the target working surface is stored in an external storage device or the like, which is connected to an internal memory or the controller 30, for example, in accordance with setting-related inputs from the operator through the input device 72, or by being downloaded from an external source (for example, a predetermined management server).

Data about the target working surface is expressed, for example, in a reference coordinate system. The reference coordinate system is, for example, the world geodetic system. The world geodetic system is a three-dimensional orthogonal XYZ coordinate system, in which the center of gravity of the Earth is the origin, with the X-axis pointing toward the intersection of the Greenwich meridian and the equator, the Y-axis pointing toward 90 degrees east longitude, and the Z-axis pointing toward the north pole. For example, the operator may set an arbitrary point on the work site as a reference point, and, using the input device 72, configure a target working surface based on the relative positional relationship with the reference point.

The working part of the bucket 6 is, for example, the teeth of the bucket 6, the back of the bucket 6, and so forth. Also, if a breaker is used as the end attachment instead of the bucket 6, the tip of the breaker serves as the working part. By this means, the controller 30 can report work information to the operator through the display device D1, sound output device D2, and the like, and guide the operator in operating the excavator 100 through the operating devices 26.

Also, the controller 30 exercises control over the excavator 100 with respect to the machine control function that, for example, assists the operator's manual operation of the excavator 100, moves the excavator 100 automatically or autonomously, and so forth. To be more specific, the controller 30 is structured to obtain a target trajectory, which is the trajectory followed by a control reference point position (hereinafter simply referred to as "control reference point") that is configured, for example, in the working part of the attachment.

If there is a working target (for example, the ground, earth and sand in the bed of a dump truck, which will be described later, etc.) that the end attachment can come into contact with, such as during excavation or compaction, the working part of the end attachment (for example, the teeth or the back of the bucket 6) may be configured as the control reference point. Also, when there is no working target that the end attachment can come into contact with, such as during boom-raising rotating movement, unloading of earth and sand, and boom-lowering rotating movement, which will be described below, any part (for example, the lower end or teeth of the bucket 6) that can define the position of the end attachment in these movements can be configured as the control reference point.

For example, the controller 30 derives the target trajectory based on data indicating the target working surface that is configured. The controller 30 may derive a target trajectory based on information about the terrain around the excavator 100 as recognized by the space recognition device 70. Also, the controller 30 may derive information about the past tracks of the working part such as the teeth of the bucket 6, from among the past outputs of the attitude detection device temporarily stored in an internal transitory storage device, and derive the target trajectory based on that information. Also, the controller 30 may derive the target trajectory based on the current position of a predetermined part of the attachment and data about the target working surface.

Note that the attitude detection device includes, for example, a boom angle sensor S1, an arm angle sensor S2, a bucket angle sensor S3, and so forth.

For example, when the operator performs a ground excavation operation or leveling operation manually, the controller 30 controls the movement of one or two of the boom 4, the arm 5, and the bucket 6 that serve as slave elements, which will be described later, such that the target working surface and the position of the tip of the bucket 6 (to be more specific, the working part of the bucket 6 such as its teeth or back) match.

To be more specific, when the operator operates the left operating lever 26L and the right operating lever 26R in the front-rear direction while operating (pressing) the switch SW, the controller 30 limits the movement of at least two of the boom 4, the arm 5, and the bucket 6, in accordance with that operation, such that target working surface and the position of the tip of the bucket 6 match.

To be more specific, when the left operating lever 26L and the right operating lever 26R are operated, the controller 30 identifies a master element based on information about the details of their operation, including the direction of the operation and the amount of the operation of the operating levers, obtained from the operation sensors 29. The master element is the moving element that moves in accordance with operational inputs by the operator or operational commands.

Also, when the master element is identified, the controller 30 identifies moving elements other than the master element as slave elements.

A slave element is a moving element whose command value is calculated according to the amount of operation of the master element, and whose movement in accordance with operational inputs by the operator or operational commands is limited. In other words, a slave element is a moving element whose movement is limited such that the amount of its operation is less than the amount of operation input by the operator.

By this means, the operator can operate the excavator 100 in the same manner as when operating the excavator 100 normally by using the left operating lever 26L and the right operating lever 26R, and still allow the excavator 100 to perform excavation or leveling along the target working surface.

Hereinafter, a moving element that moves in accordance with the operator's operational inputs, or operational commands that relate to the autonomous driving function, and the actuator that drives that moving element, may be collectively referred to as a "master element," or each one of them may be individually referred to as a "master element," and the same applies to slave elements as well, which will be described later.

The following description will proceed on the assumption that the machine control function is enabled when the left operating lever 26L and the right operating lever 26R are operated while the switch SW is pressed.

Next, examples of the machine control function of the excavator 100 according to the present embodiment will be described in detail with reference to FIG. 6A and FIG. 6B.

Detailed structures related to examples of the machine control function of the excavator 100 will be described with reference to FIG. 6A and FIG. 6B.

Figure 6A:
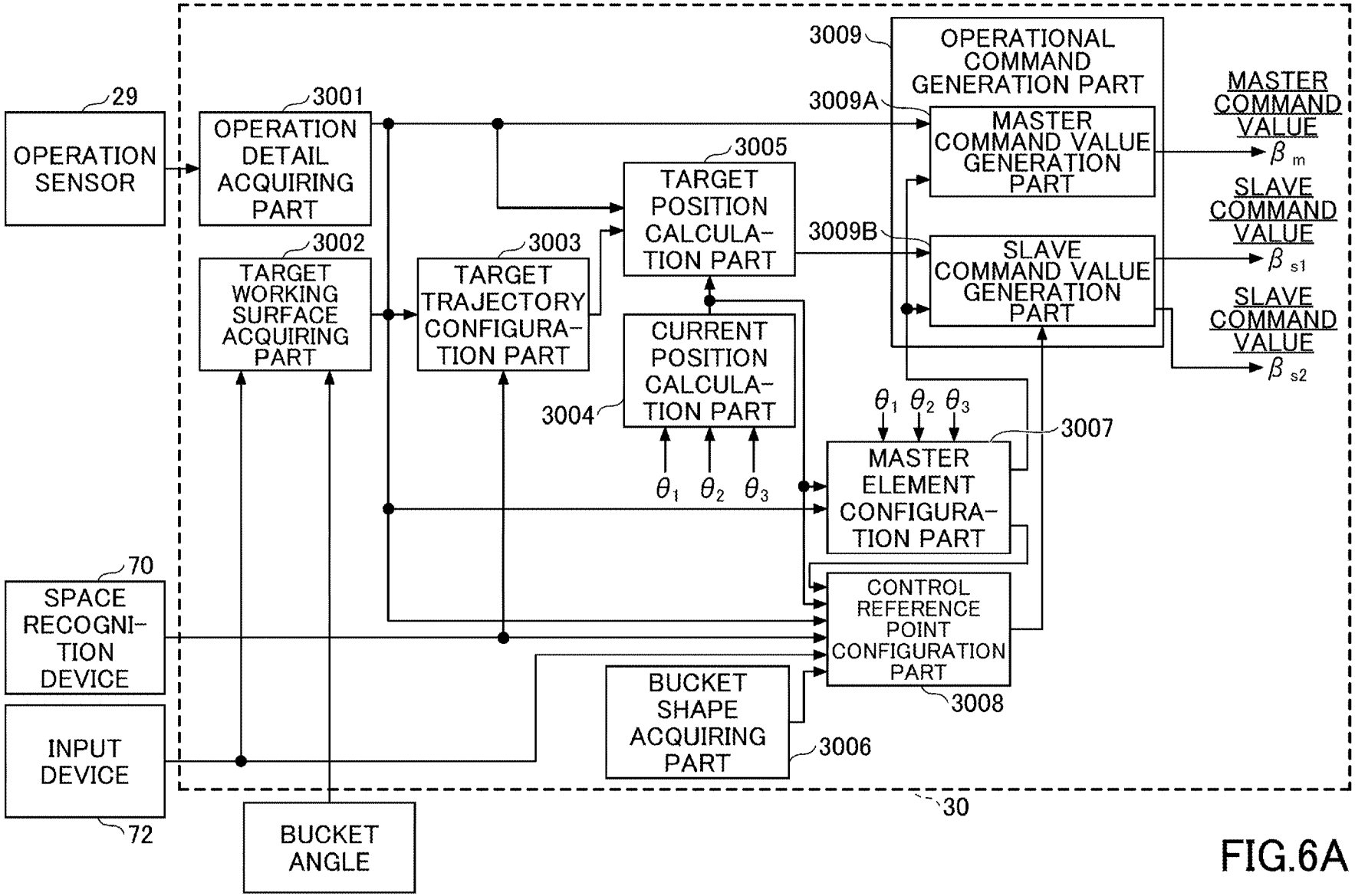
FIG. 6A is a first functional block diagram that shows a detailed structure related to a semi-automatic driving function of the excavator.
Figure 6B:
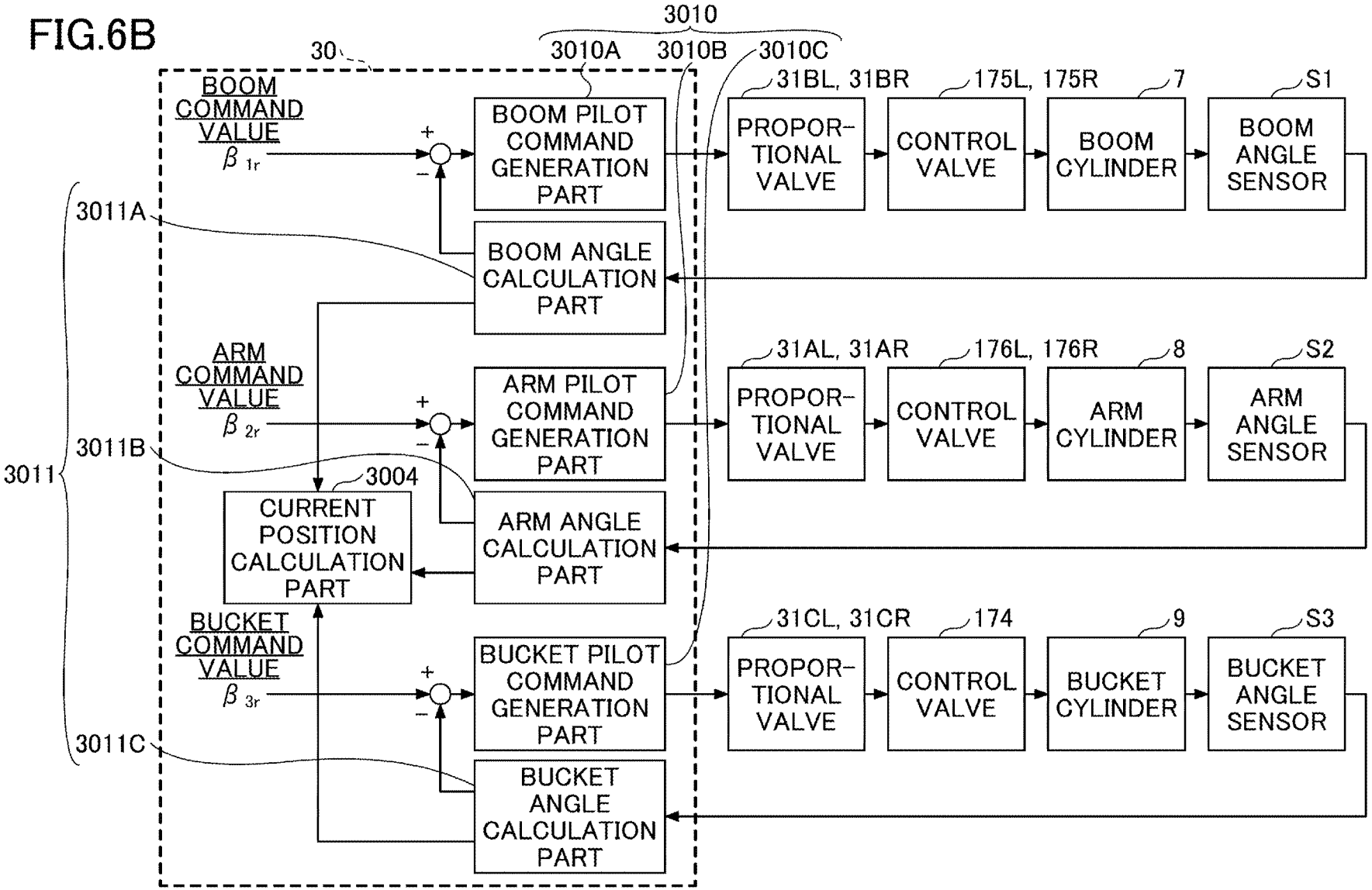
FIG. 6B is a second functional block diagram that shows a detailed structure related to the semi-automatic driving function of the excavator.

FIG. 6A and FIG. 6B are functional block diagrams that each show an example of a detailed structure related to the machine control function of the excavator 100 according to the present embodiment. To be more specific, FIG. 6A is a first functional block diagram that shows a detailed structure related to the semi-automatic driving function of the excavator, and FIG. 6B is a second functional block diagram that shows a detailed structure related to the semi-automatic driving function of the excavator.

As shown in FIG. 6A and FIG. 6B, the controller 30, which implements the semi-automatic driving functions of the excavator 100, includes an operation detail acquiring part 3001, a target working surface acquiring part 3002, a target trajectory configuration part 3003, a current position calculation part 3004, a target position calculation part 3005, a bucket shape acquiring part 3006, a master element configuration part 3007, a control reference point configuration part 3008, a movement command generation part 3009, a pilot command generation part 3010, and an attitude angle calculation part 3011, as functional parts related to the machine control function. For example, when the switch SW is pressed and operated, these functional parts repeat the movements described below, in a predetermined control cycle.

The operation detail acquiring part 3001 acquires the details of operation regarding the front-rear and/or left-right tilting operations of the left operating lever 26L and/or the right operating lever 26R, based on detection signals taken in from the operation sensors 29.

For example, the operation detail acquiring part 3001 acquires (calculates) the direction of operation (that is, whether the left operating lever 26L and/or the right operating lever 26R are operated in the forward direction, the rear direction, the left direction, or the right direction) and the amount of operation, as information that indicates the details of their operation. Also, when the excavator 100 is remotely operated, the semi-automatic driving function of the excavator 100 may be implemented based on the details of remote operation signals received from an external device. In this case, the operation detail acquiring part 3001 acquires information that indicates the details of remote operation based on remote operation signals received from an external device. In the following description, the information that indicates the details of operation, acquired by the operation detail acquiring part 3001, will be referred to as "operation detail information."

The operation detail information includes information about the tilting operations of the left operating lever 26L and/or the right operating lever 26R in the front-rear direction and/or the left-right direction. In other words, the operation detail information includes at least one of information that indicates the details of operation pertaining to the boom 4, information that indicates the details of operation pertaining to the arm 5, and information that indicates the details of operation pertaining to the end attachment.

To be more specific, the operation detail information includes at least one of: the direction of operation and the amount of operation for the boom 4; the direction of operation and the amount of operation for the arm 5; and the direction of operation and the amount of operation for the bucket 6.

The target working surface acquiring part 3002 acquires data about the target working surface, which is input from the input device 72 and the like.

The target trajectory configuration part 3003 configures information about the target trajectory of the tip of the attachment AT, in order to move the tip of the attachment AT along the target working surface, based on the data about the target working surface. To be more specific, the tip of the attachment AT refers to a predetermined part of the end attachment (for example, the teeth or back of the bucket 6) that serves as a control reference point.

For example, the target trajectory configuration part 3003 may configure, as information about the target trajectory, the tilt angle of the target working surface in the front-rear direction, with reference to the body (upper rotating body 3) of the excavator 100. Also, an allowable error range may be configured for the target trajectory (hereinafter referred to as "allowable error range"). In this case, the information about the target trajectory may include information about the allowable error range.

The current position calculation part 3004 calculates the position (current position) of the control reference point in the attachment AT (for example, the working part of the bucket 6 such as its teeth or back). To be more specific, the current position calculation part 3004 calculates the (current) position of the control reference point of the attachment AT based on a boom angle θ1, an arm angle θ2, and a bucket angle θ3, calculated by an attachment angle calculation part 3011, which will be described later.

In the semi-automatic driving function of the excavator 100, the target position calculation part 3005 calculates the target position of the tip (control reference point) of the attachment AT, based on the details of operational inputs by the operator, information about the configured target trajectory, and the current position of the control reference point (working part) in the attachment AT.

The details of operation include, for example, the direction of operation and the amount of operation. Assuming that the arm 5 moves according to the direction of operation and the amount of operation indicated by the operator's operational inputs, this target position is a position on the target trajectory that should be reached in the current control cycle.

The target position calculation part 3005 may calculate the target position of the tip of the attachment AT by using, for example, a map, an arithmetic expression, and so forth, stored in advance in a non-volatile internal memory or the like.

Also, in the autonomous driving function of the excavator 100, the target position calculation part 3005 calculates the target position of the tip (control reference point) of the attachment AT based on an operational command input from the operation detail acquiring part 3001, the information about the configured target trajectory, and the current position of the control reference point (working part) in the attachment AT. By this means, the controller 30 can autonomously control the excavator 100 independently of operations by the operator.

The bucket shape acquiring part 3006 acquires data about the pre-registered shapes of the bucket 6 from, for example, an internal memory, a predetermined external storage device, or the like. At this time, provided that a plurality of types of data are registered in advance about the shape of the bucket 6, the bucket shape acquiring part 3006 acquires the type of data about the shape of the bucket 6 that is configured by a setting-related operation via the input device 72.

Among the moving elements that constitute the attachment AT (that is, the actuators that drive these moving elements), the master element configuration part 3007 configures a moving element (actuator) (hereinafter referred to as "master element") that works in accordance with operational inputs by the operator or operational commands, the moving elements that constitute the attachment AT include the boom 4, the arm 5, and the bucket 6. In other words, the attachment AT includes multiple moving elements.

To be more specific, the master element configuration part 3007 calculates the angular velocity of the boom 4 (hereinafter referred to as "boom angular velocity"), the angular velocity of the arm 5 (hereinafter referred to as "boom angular velocity"), and the angular velocity of the bucket 6 (hereinafter referred to as "bucket angular velocity") based on the operation detail information acquired in the operation detail acquiring part 3001, the data about the target working surface, and the current position of the control reference point (teeth) of the attachment AT.

Then, the master element configuration part 3007 determines a velocity vector, which includes the direction and speed of the movement of the teeth of the bucket 6, from the boom angular velocity, and calculates the vertical component of this velocity vector with respect to the target working surface. In other words, the master element configuration part 3007 calculates the vertical component of a velocity vector of the teeth of the bucket 6, which is produced from the operation of the boom 4, with respect to the target working surface.

Also, the master element configuration part 3007 determines a velocity vector, which includes the direction and speed of the movement of the teeth of the bucket 6, from the arm angular velocity, and calculates the vertical component of this velocity vector with respect to the target working surface. In other words, the master element configuration part 3007 calculates the vertical component of a velocity vector of the teeth of the bucket 6, which is produced from the operation of the arm 5, with respect to the target working surface.

Also, the master element configuration part 3007 calculates a velocity vector, which includes the direction and speed of the movement of the teeth of the bucket 6, from the bucket angular velocity, and calculates the vertical component of this velocity vector with respect to the target working surface. In other words, the master element configuration part 3007 calculates the vertical component of a velocity vector of the teeth of the bucket 6, which is produced from the operation of the bucket 6, with respect to the target working surface.

Then, the master element configuration part 3007 of the present embodiment compares the magnitudes of the vertical components calculated thus, and configures the moving element, in which the vertical component of the velocity vector of the teeth of the bucket 6 with respect to the target working surface has the smallest magnitude, as the master element. In other words, the master element configuration part 3007 of the present embodiment calculates, for each moving element, the vertical component of the velocity vector of the teeth (control reference point) of the bucket 6, with respect to the target working surface, from operation detail information corresponding to that moving element, and configures the moving element in which this vertical component has the smallest magnitude, as the master element.

Also, when the master element is specified, the master element configuration part 3007 configures moving elements other than the master element as slave elements.

To be more specific, the master element configuration part 3007 outputs a request for generation of master command values that correspond to the moving element specified as the master element, to a master command value generation part 3009A, which will be described later. Also, the master element configuration part 3007 outputs a request for generation of slave command values that correspond to the moving elements specified as slave elements, to a slave command value generation part 3009B, which will be described later.

The control reference point configuration part 3008 configures the control reference point in the attachment AT. For example, the control reference point configuration part 3008 may configure the control reference point in the attachment AT in accordance with an operation by the operator or the like, through the input device 72. Also, for example, the control reference point configuration part 3008 may automatically change the setting of the control reference point of the attachment AT when a predetermined condition is satisfied.

The movement command generation part 3009 generates a command value $\beta_{1r}$ for the movement of the boom 4 (hereinafter referred to as "boom command value"), a command value $\beta_{2r}$ for the movement of the arm 5 (hereinafter referred to as "arm command value"), and a command value $\beta_{3r}$ for the movement of the bucket 6 (hereinafter referred to as "bucket command value"), based on the target position of the control reference point in the attachment AT. For example, boom command value $\beta_{1r}$, arm command value $\beta_{2r}$, and bucket command value $\beta_{3r}$ are, respectively, the angular velocity of the boom 4 (hereinafter referred to as "boom angular velocity"), the angular velocity of the arm 5 (hereinafter referred to as "boom angular velocity"), and the angular velocity of the bucket 6 (hereinafter referred to as "bucket angular velocity"), that are necessary for the control reference point in the attachment AT to arrive at the target position. The movement command generation part 3009 includes a master command value generation part 3009A and a slave command value generation part 3009B.

Note that the boom command value, arm command value, and bucket command value may be the boom angle, arm angle, and bucket angle when the control reference point in the attachment AT arrives at the target position. Also, the boom command value, arm command value, and bucket command value may be the angular acceleration or the like that is necessary for the control reference point in the attachment AT to arrive at the target position.

The master command value generation part 3009A generates a command value $\beta_m$ (hereinafter referred to as "master command value") for the movement of the master element among the moving elements constituting the attachment AT (the boom 4, the arm 5, and the bucket 6).

For example, when the boom 4 (boom cylinder 7) is configured as the master element by the master element configuration part 3007, the master command value generation part 3009A generates boom command value $\beta_{1r}$ as master command value $\beta_m$, and outputs this to the pilot command generation part 3010A.

Also, when the arm 5 (arm cylinder 8) is configured as the master element by the master element configuration part 3007, the master value generation part 3009A generates arm command value $\beta_{2r}$, and outputs this to the arm pilot command generation part 3010B. Also, when the bucket 6 (bucket cylinder 9) is the master element configured by the master element configuration part 3007, the master command value generation part 3009A generates bucket command value $\beta_{3r}$ as master command value $\beta_m$, and outputs this to the bucket pilot command generation part 3010C.

To be more specific, the master command value generation part 3009A generates master command value $\beta_m$ that matches the details of operation (the direction of operation and the amount of operation) by the operator or an operational command. For example, the master command value generation part 3009A may generate boom command value $\beta_{1r}$, arm command value $\beta_{2r}$, and bucket command value $\beta_{3r}$ as master command values, based on a predetermined map, a conversion formula, and the like that defines the relationship between the details of operation by the operator or an operational command, and generate boom command value $\beta_{1r}$, arm command value $\beta_{2r}$, and bucket command value $\beta_{3r}$ as master command values.

The slave command value generation part 3009B controls the movement of the slave elements in accordance with the movement of the master element, among the moving elements constituting the attachment AT. To be more specific, for example, the slave command value generation part 3009B calculates the angular velocity of the slave elements, based on the angular velocity of the master element, data about the target working surface, and the current position of the control reference point, such that the angular velocity of the master element and the angular velocity of the slave elements satisfy a predetermined condition. Then, the slave command value generation part 3009B generates and outputs command values $\beta_{s1}$ and $\beta_{s2}$ (hereinafter referred to as "slave command values") for the movement of the slave elements according to the angular velocity calculated thus.

With the present embodiment, slave command values are generated in this way, and these slave command values are smaller than slave command values that match the amount of operation by the operator, and limit the movement of the slave elements.

For example, when the boom 4 is configured as the master element by the master element configuration part 3007, the slave command value generation part 3009B generates arm command value $\beta_{2r}$ and bucket command value $\beta_{3r}$ as slave command values $\beta_{s1}$ and $\beta_{2r}$, and output these to the arm pilot command generation part 3010B and to the bucket pilot command generation part 3010C, respectively.

When the arm 5 is configured as the master element by the master element configuration part 3007, the slave command value generation part 3009B generates boom command value $\beta_{1r}$ and bucket command value $\beta_{3r}$ as slave command values $\beta_{s1}$ and $\beta_{s2}$, and output these to the boom pilot command generation part 3010A and to the bucket pilot command generation part 3010C, respectively.

When the bucket 6 is configured as the master element by the master element configuration part 3007, the slave command value generation part 3009B generates boom command value $\beta_{2r}$ and arm command value $\beta_{2r}$ as slave command values $\beta_{s1}$ and $\beta_{s2}$, and outputs these to the boom pilot command generation part 3010A and to the arm pilot command generation part 3010B, respectively.

To be more specific, the slave command value generation part 3009B generates slave command values $\beta_{1r}$ and $\beta_{2r}$ such that the slave elements move in accordance with (in sync with) the movement of the master element corresponding to master command value $\beta_m$, based on slave command values that correspond to amounts of operation that are smaller than the amounts of operation by the operator.

In this way, the controller 30 limits the movement of the two slave elements of the attachment AT, in accordance with (in sync with) the movement of the master element of the attachment AT that follows operational inputs by the operator or operational commands.

In other words, the master element (its hydraulic actuator) moves in accordance with operational inputs by the operator or operational commands, and the movement of the slave elements (their hydraulic actuators) is controlled in accordance with the movement of the master element (its hydraulic actuator) such that the slave elements move in amounts of operation that are smaller than the amounts of operation by the operator.

Therefore, according to the present embodiment, even if the operator operates the excavator 100 in the same way as when the machine control function is not used, it is still possible to prevent the excavator 100 from digging the target working surface too much, and reduce the stress that the operator feels during operation of the excavator 100.

Also, according to the present embodiment, near the target working surface, the movement of the slave elements is limited compared to the amount of operation by the operator, so that the operator can recognize that the target working surface is near.

The pilot command generation part 3010 generates command values for the pilot pressures (hereinafter referred to as "pilot pressure command values") to apply to the control valves 174 to 176, so as to achieve the boom angular velocity, arm angular velocity, and bucket angular velocity that match boom command value $\beta_{1r}$, arm command value $\beta_{2r}$, and bucket command value $\beta_{3r}$. The pilot command generation part 3010 includes a boom pilot command generation part 3010A, an arm pilot command generation part 3010B, and a bucket pilot command generation part 3010C.

The boom pilot command generation part 3010A generates pilot pressure command values to apply to the control valves 175L and 175R, associated with the boom cylinder 7 that drives the boom 4, based on the deviation between boom command value $\beta_{1r}$ and the value (measured value) of the current boom angular velocity calculated by a boom angle calculation part 3011A, which will be described later. Then, the boom pilot command part generation 3010A outputs control currents that match the generated pilot pressure command values, to the proportional valves 31BL and 31BR.

By this means, as described above, pilot pressures that match the pilot pressure command values output from the proportional valves 31BL and 31BR are applied to the corresponding pilot ports of the control valves 175L and 175R. Then, by the working of the control valves 175L and 175R, the boom cylinder 7 moves, and the boom 4 moves so as to achieve a boom angular velocity that matches boom command value $\beta_{1r}$.

The arm pilot command generation part 3010B generates pilot pressure command values to apply to the control valves 176L and 176R, associated with the arm cylinder 8 that drives the arm 5, based on the deviation between arm command value $\beta_{2r}$ and the value (measured value) of the current arm angular velocity calculated by an arm angle calculation part 3011B, which will be described later. Then, the boom pilot command part generation 3010B outputs control currents that match the generated pilot pressure command values, to the proportional valves 31AL and 31AR.

By this means, as described above, pilot pressures that match the pilot pressure command values output from the proportional valves 31AL and 31AR are applied to the corresponding pilot ports of the control valves 176L and 176R. Then, by the working of the control valves 176L and 176R, the arm cylinder 8 moves, and the arm 5 moves so as to achieve an arm angular velocity that matches arm command value $\beta_{2r}$.

The bucket pilot command generation part 3010C generates pilot pressure command values to apply to the control valve 174, corresponding to the bucket cylinder 9 that drives the bucket 6, based on the deviation between bucket command value $\beta_{3r}$ and the value (measured value) of the current bucket angular velocity calculated by the bucket angle calculation part 3011C, which will be described later. Then, the bucket pilot command part generation 3010C outputs control currents that match the generated pilot pressure command values, to the proportional valves 31CL and 31CR.

By this means, as described above, pilot pressures that match the pilot pressure command values output from the proportional valves 31CL and 31CR are applied to the corresponding pilot ports of the control valve 174. Then, by the working of the control valve 174, the bucket cylinder 9 moves, and the bucket 6 moves so as to achieve a bucket angular velocity that matches bucket command value $\beta_{3r}$.

The attitude angle calculation part 3011 calculates (measures) the (current) boom angle, arm angle, and bucket angle, as well as boom angular velocity, arm angular velocity, and bucket angular velocity, based on detection signals from the boom angle sensor S1, arm angle sensor S2, and bucket angle sensor S3. The attitude angle calculation part 3011 includes a boom angle calculation part 3011A, an arm angle calculation part 3011B, and a bucket angle calculation part 3011C.

The boom angle calculation part 3011A calculates (measures) the boom angle, boom angular velocity, and so forth, based on the detection signal taken in from the boom angle sensor S1. By this means, the boom pilot command generation part 3010A can exercise feedback control for the movement of the boom cylinder 7, based on the measurement result by the boom angle calculation part 3011A.

The arm angle calculation part 3011B calculates (measures) the arm angle, arm angular velocity, and so forth, based on the detection signal taken in from the arm angle sensor S2. By this means, the arm pilot command generation part 3010B can exercise feedback control for the movement of the arm cylinder 8, based on the measurement result by the arm angle calculation part 3011B.

The bucket angle calculation part 3011C calculates (measures) the bucket angle, bucket angular velocity, and so forth, based on the detection signal taken in from the bucket angle sensor S3. By this means, the bucket pilot command generation part 3010C can exercise feedback control for the movement of the bucket cylinder 9, based on the measurement result by the bucket angle calculation part 3011C.

Figure 7:
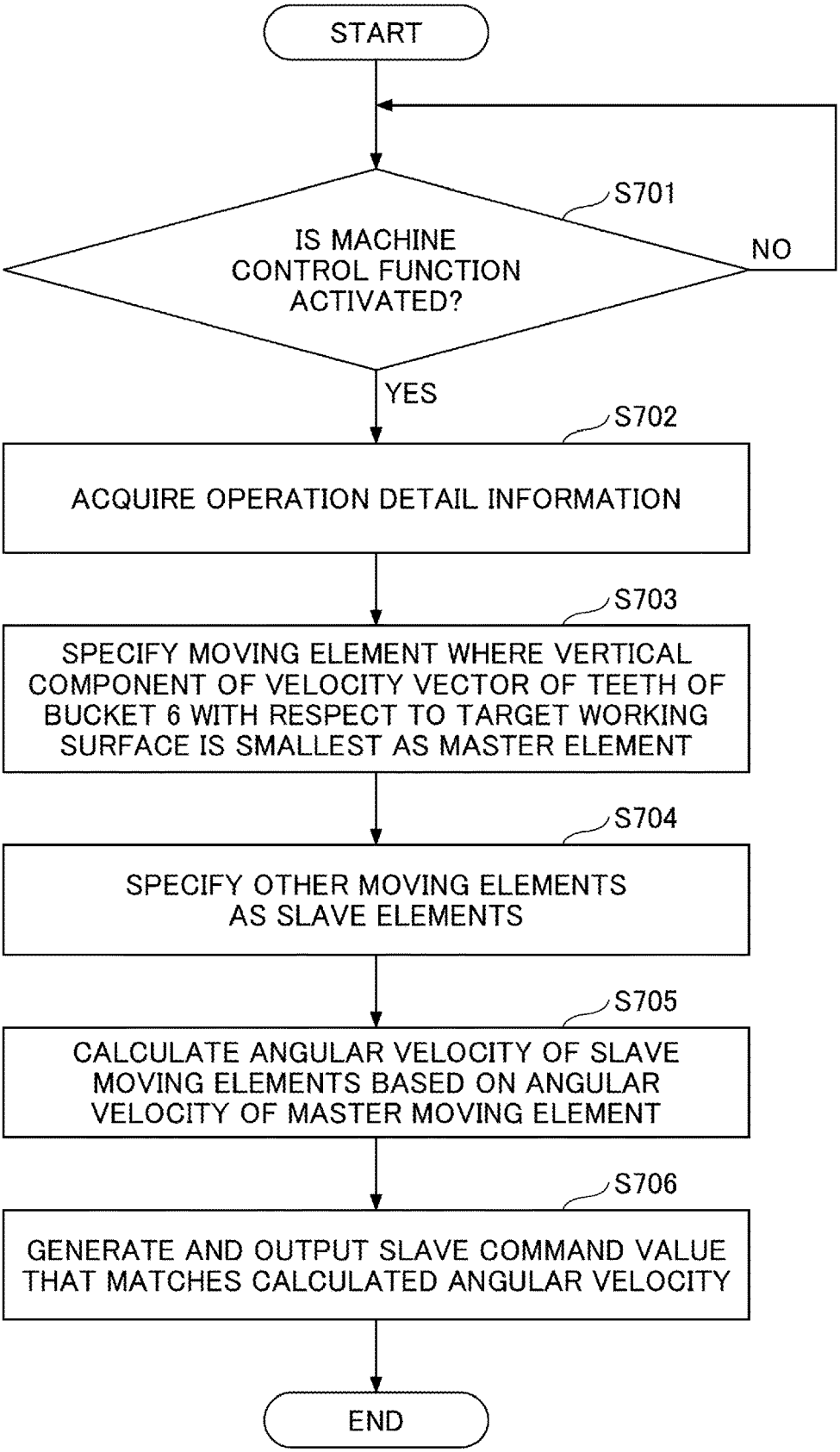
FIG. 7 is a flowchart for explaining a process by the excavator's controller.

Next, the process by the controller 30 of the present embodiment will be described with reference to FIG. 7. FIG. 7 is a flowchart for explaining the process by an excavator controller.

The controller 30 of the excavator 100 of the present embodiment determines whether the machine control function is activated (step S701). In other words, the controller 30 determines whether the switch SW is pressed.

In step S701, if the machine control function is not activated, the controller 30 waits.

Also, if the machine control function is activated in step S701, the controller 30 operation detail information through the operation detail acquiring part 3001 (step S702).

Next, the controller 30, using the master element configuration part 3007, specifies the moving element, in which the vertical component of the tooth velocity vector of the bucket 6 with respect to the target working surface, produced by the operation of the controller 30, is the smallest, among the moving elements for which the operation detail information is acquired, and configures that moving element as the master element (step S703). Also, the master element configuration part 3007 configures the moving elements other than the master element as slave elements (step S704).

Next, the controller 30 calculates the angular velocity of the slave elements through a slave command value generation part 3009B (step S705), generates a slave command value according to the calculated angular velocity, and outputs it to the pilot command generation part 3010 (step S706).

Note that, in the example of FIG. 7, the controller 30 executes the process from step S702 onward when the switch SW is operated and the machine control function is activated, but this is by no means limiting.

With the present embodiment, for example, when a mode to activate the machine control function is configured in the input device 72 or the like, the process from step S702 onward in FIG. 7 may be executed.

Also, when the position of the control reference point (the teeth of the bucket 6) is detected to be within a predetermined range from the target working surface, the controller 30 may automatically activate the machine control function and execute the process from step S702 onward.

By exercising this control, the control reference point can be moved along the target working surface, for example, even if the operator forgets to operate the switch SW.

Also, according to the present embodiment, by exercising this control, the control reference point can be moved along the target working surface, without making the operator aware of whether to turn on or off the machine control function, so that it is possible to reduce the stress that the operator feels during operation of the excavator 100.

Figure 8:
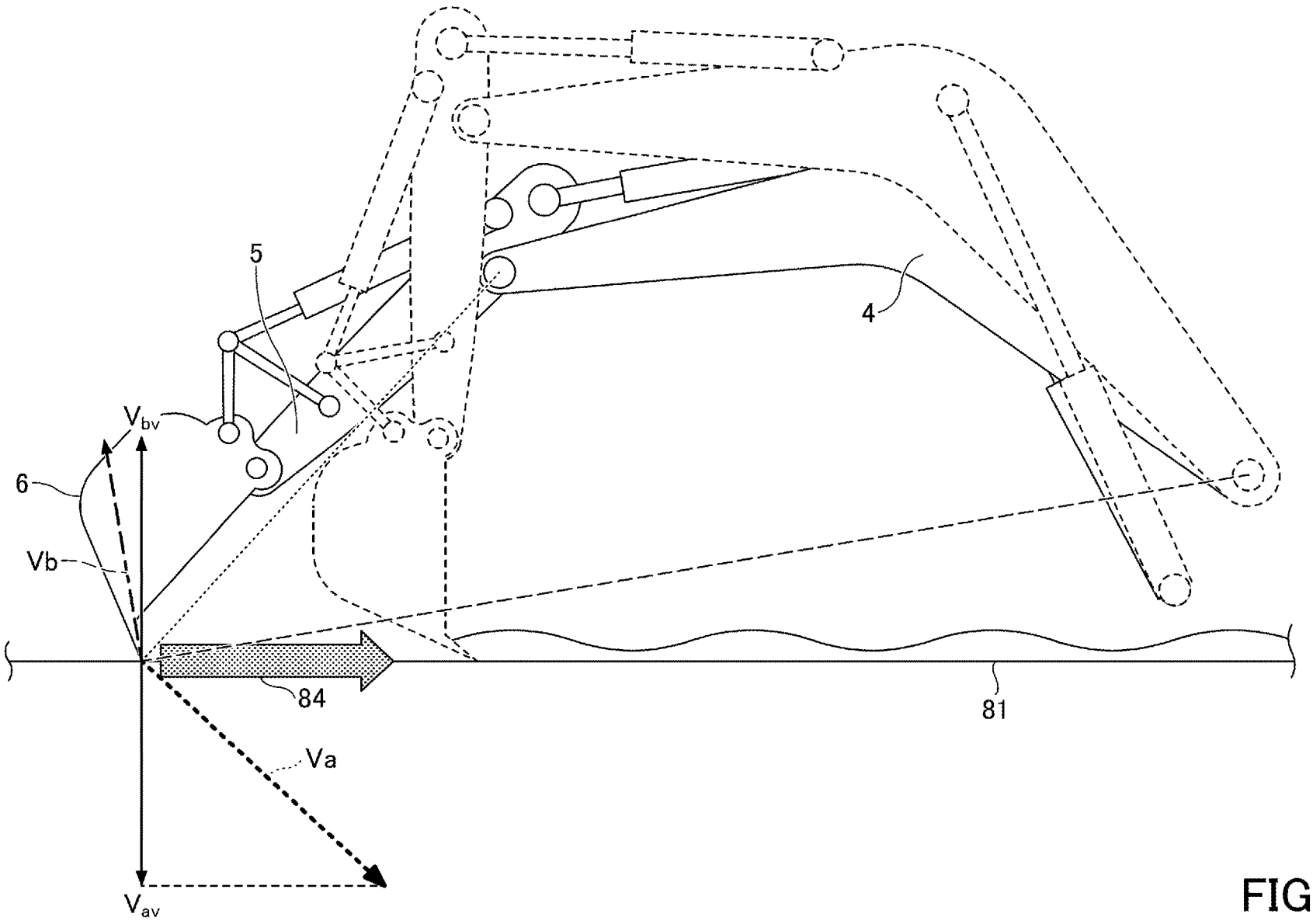
FIG. 8 is a diagram for explaining the process by the controller.

The process by the controller 30 will be further described below with reference to FIG. 8. FIG. 8 is a diagram that shows the process by the controller.

FIG. 8 assumes a case in which the operator of the excavator 100 performs an operation to move the teeth of the bucket 6 horizontally in order to shape the target working surface 81. To be more specific, in FIG. 8 assumes that an operation to move the teeth of the bucket 6 in the direction indicated by an arrow 84 in the figure, along the target working surface 81, is performed.

In this case, in the controller 30, the operation detail information acquired by the operation detail acquiring part 3001 includes operation detail data that indicates the boom-raising direction, the amount of operation for the boom 4, operation detail data that indicates the arm-folding direction, and the amount of operation for the arm 5. In other words, the operation detail information includes the amount of operation for each of the two types of moving elements.

Therefore, the controller 30 calculates the vertical component of the tooth velocity vector Vb of the bucket 6 with respect to the target working surface 81 by using operation detail data that corresponds to operation of the boom 4. In addition, the controller 30 calculates the vertical component of the tooth velocity vector Va of the bucket 6 with respect to the target working surface 81 by using operation detail data that corresponds to operation of the arm 5. The controller 30 compares these two vertical components, and specifies the moving element with the smaller vertical component as the master element.

For example, when the vertical component of the tooth velocity vector of the bucket 6 with respect to the target working surface 81, calculated from the operation detail information for the arm 5, is smaller than the vertical component of the tooth velocity vector of the bucket 6 with respect to the target working surface 81, calculated from the operation detail information for the boom 4, the controller 30 makes the arm 5 the master element and the boom 4 the slave element.

Next, the controller 30 calculates the angular velocity of the slave element based on the angular velocity of the arm 5, which is the master element, and generates a slave command value based on the calculated angular velocity.

In FIG. 8, the controller 30 determines the angular velocity of the arm 5 from the operation detail information for the arm 5, and determines a vertical component $V_{av}$ of the tooth velocity vector Va of the bucket 6 with respect to the target working surface 81, from the angular velocity of the arm 5. Also, the controller 30 determines the angular velocity of the boom 4 from the operation detail information for the boom 4, and determines a vertical component $V_{bv}$ of the tooth velocity vector Vb of the bucket 6 with respect to the target working surface 81, from the angular velocity of the boom 4. Then, the controller 30 calculates the vertical component $V_{bv}$ that allows $V_{av}+V_{bv}=0$ to hold, and, using this vertical component $V_{bv}$, calculates the angular velocity of the boom 4. Then, the controller 30 generates a slave command value according to the angular velocity calculated.

Also, for example, when the vertical component of the velocity vector of the teeth of the bucket 6 with respect to the target working surface 81, calculated from the boom's operation detail information, is smaller than the vertical component of the velocity vector of the teeth of the bucket 6 with respect to the target working surface 81, calculated from the operation detail information for the arm 5, the controller 30 makes the boom 4 the master element. Then, the controller 30 makes the arm 5 the slave element, calculates the angular velocity of the arm 5, which is the slave element, based on the angular velocity of the boom 4, which is the master element, and generates a slave command value based on the calculated angular velocity.

At this time, the controller 30 may calculate the angular velocity of the arm 5 such that the relationship between the vertical component $V_{av}$ of the velocity vector Va of the teeth of the bucket 6, which is calculated from the operation detail information for the arm 5, and the vertical component $V_{bv}$ of the velocity vector Vb of the teeth of the bucket 6, which is calculated from the operation detail information for the boom 4, holds in accordance with $V_{av}+V_{bv}=0$, and generate a slave command value in accordance with the calculated angular velocity.

Note that, in the example of FIG. 8, the slave command value is generated by using the vertical component of the tooth velocity vector of the bucket 6 with respect to the target working surface, but this is by no means limiting.

The controller 30 may calculate, for example, a boom angle θ1, an angular velocity ω1 of the boom 4, an arm angle θ2, an angular velocity ω2 of the arm 5, a bucket angle θ3, and an angular velocity ω3 of the bucket 6, and generate slave command values such that the angles and angular velocities are in with accordance the following relationships:

$$\theta_1 + \theta_2 + \theta_3 = \theta_t$$

$$\omega 1 + \omega 2 + \omega 3 = 0$$

Note that the angle $\theta_t$ is the target angle, and the target angle may be calculated by using the angle formed by the back surface of the bucket 6 and the plane connecting between the teeth of the bucket 6 and the bucket pin, and the tilt angle of the target working surface.

Also, in the example of FIG. 8, the operation detail information includes the details of operation for the boom 4 and the details of operation for the arm 5, but this is by no means limiting. The operation detail information may include the details of operation for the boom 4 and the details of operation for the arm 5, as well as the details of operation for the bucket 6.

In this case, the operation detail information includes operation detail data that indicates the direction of operation for the boom 4, the amount of operation for the boom 4, operation detail data that indicates the direction of operation for the arm 5, the amount of operation for the arm 5, operation detail data that indicates the direction of operation for the bucket 6, and the amount of operation for the bucket 6. In other words, the operation detail information includes the amount of operation for each of the three types of moving elements.

In this case, too, as described earlier, based on the operation detail information corresponding to each moving element's operation, the controller 30 makes the moving element, in which the vertical component of the velocity vector of the teeth (control reference point) of the bucket 6 with respect to the target working surface has the smallest magnitude, the master element, and makes the other moving elements slave elements.

To be more specific, for example, if the bucket 6 is configured as the master element, the boom 4 and arm 5 are the slave elements.

In this case, using the angular velocity ω3 of the bucket 6, the controller 30 may calculate the angular velocity ω1 of the boom 4 and the angular velocity ω2 of the arm 5 such that ω1+ω2+ω3=0 holds.

Also, according to the present embodiment, if Operation detail information is available with respect to only one moving element, that is, if only one of the boom 4, the arm 5, and the bucket 6 is operated, the controller 30 may stop the movement of the excavator 100 when the control reference point comes within a predetermined range from the target working surface.

Operation detail information is available with respect to only one moving element, for example, when a state in which two or more moving elements among the boom 4, the arm 5, and the bucket 6 are operated switches to a state in which only one moving element among the boom 4, the arm 5, and the bucket 6 is operated.

Also, according to the present embodiment, when the details of operation for one moving element are the only operation detail information and the operation detail information pertains to the arm 5, the controller 30 may make the arm 5 alone a moving element that can be operated by the operator, when the control reference point comes within a predetermined range from the target working surface, and the movements of the boom 4 and the bucket 6 may be controlled by the controller 30.

By limiting the movement of moving elements in this way, it is possible to prevent, for example, digging deeper than the target working surface due to the operator's operation.

Figure 9:
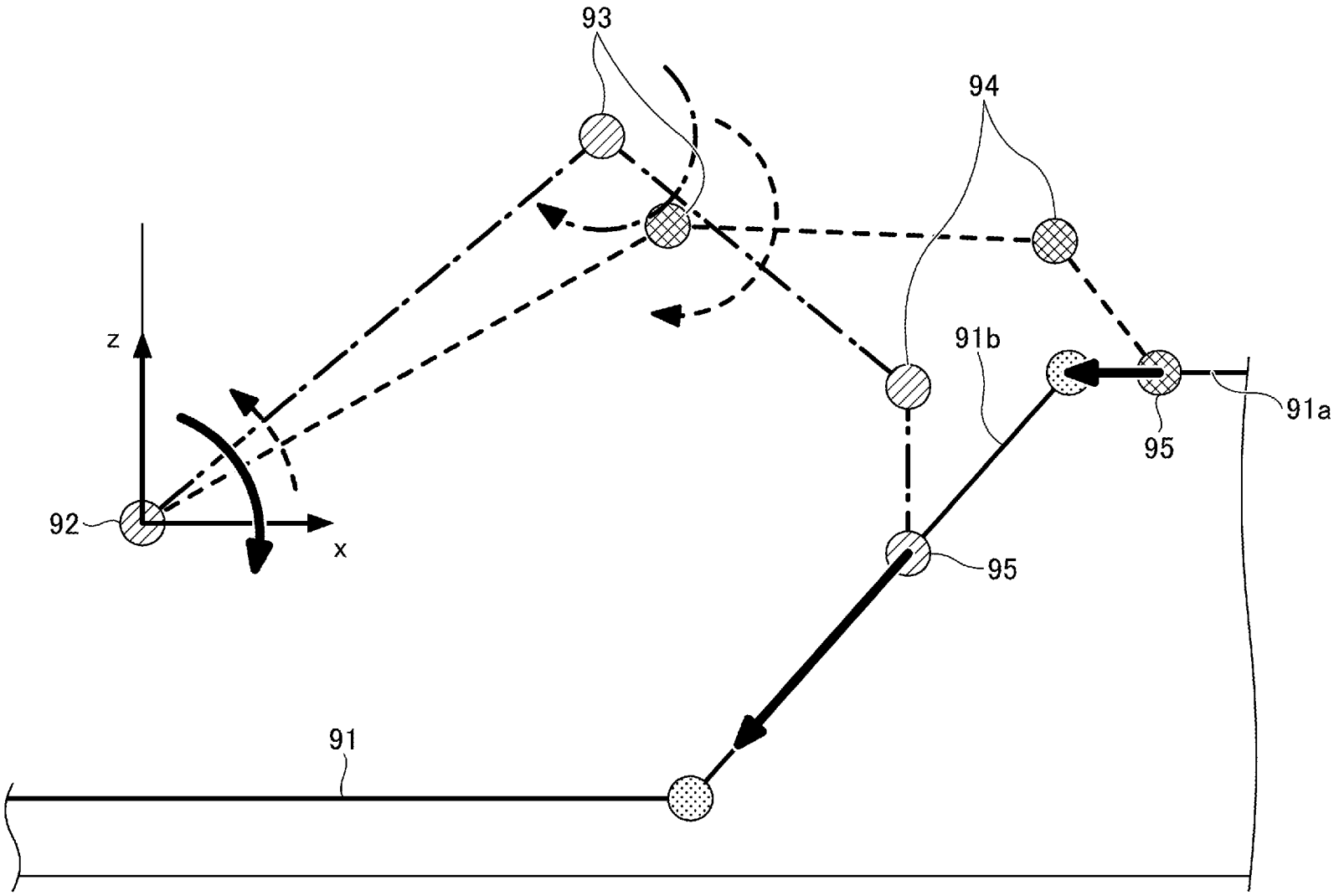
FIG. 9 is a diagram for explaining an effect of an embodiment of the present invention.

Effects that are brought about when the present embodiment is put to use will be described below with reference to FIG. 9. FIG. 9 is a diagram that shows the effect of the present embodiment.

The target working surface 91 shown in FIG. 9 includes a horizontal surface 91*a* and a slope surface 91*b*. Also, in FIG. 9, a point 92 indicates the position of a boom foot pin, a point 93 indicates the position of a boom top pin, a point 94 indicates the position of an arm top pin, and a point 95 indicates the position of the tip of the teeth of the bucket 6.

In other words, the point 95 indicates the position of the contact point between the teeth of the bucket 6 and the target working surface 91.

Also, in the example of FIG. 9, the machine control function may be used, and the arm 5 alone is operated by the operator, while the operation of the boom 4 and the bucket 6 is controlled automatically, by the controller 30, in accordance with the operation of the arm 5.

Assuming such control is executed, a case will be considered here in which, for example, the operator operates the arm 5 to close, such that the point 95 moves from a position on the horizontal surface 91*a* to a position on the slope surface 91*b*.

In this case, the controller 30 raises the boom 4 automatically and controls the teeth of the bucket 6 to move along the target working surface 91, in accordance with the operator's operation of the arm 5.

At this time, for example, if the position of the point 95 moves from the horizontal surface 91*a* to the slope surface 91*b*, the movement speed of the teeth of the bucket 6 increases suddenly even if the operator operates the arm 5 to keep a constant movement speed. Such a change in speed might make the operator operating the arm 5 feel stress.

By contrast with this, according to the present embodiment, the operator can operate all of multiple moving elements. Also, according to the present embodiment, among multiple moving elements, the moving element, in which the vertical component of the velocity vector of the control reference point with respect to the target working surface has the smallest magnitude, which is calculated from operation detail information, is the master element, and other moving elements are slave elements, and the movement of the slave elements is limited such that the amount of operation for the slave elements is smaller than the amount of operation intended by the operator.

Therefore, according to the present embodiment, the control reference point can be moved along the target working surface without making the operator feel stressed.

Figure 10:
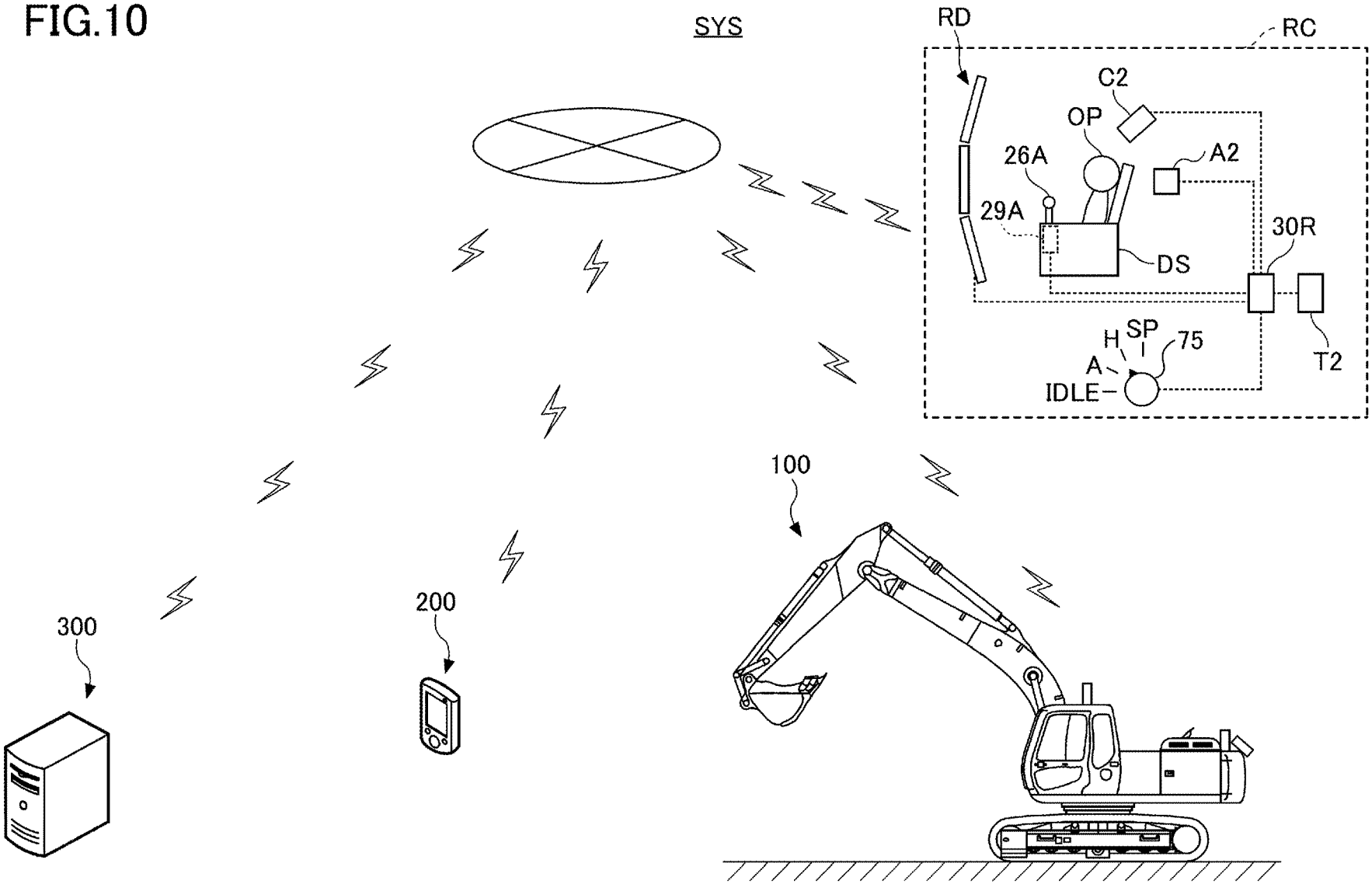
FIG. 10 is a diagram for explaining the excavator's operation system.

Next, a case will be described here with reference to FIG. 10, in which the excavator 100 of the present embodiment is operated remotely. FIG. 10 is a diagram for explaining the excavator's operation system.

As shown in FIG. 10, the operation system SYS includes an excavator 100, an assisting device 200, and a managing device 300. The operation system SYS is structured to assist construction work involving one excavator 100 or multiple excavators 100.

Information acquired by the excavator 100 may be shared with the manager, other excavators' operators, and others, through the operation system SYS. The operation system SYS may be constituted by one excavator 100, assisting device 200, and managing device 300, or may be constituted by multiple excavators 100, assisting devices 200, and managing devices 300. In this example, the operation system SYS includes one excavator 100, one assisting device 200, and one managing device 300.

The assisting device 200 is typically a portable terminal device that a worker at a work site carries with him/her, such as a laptop computer terminal, a tablet terminal, a smartphone, and so forth. The assisting device 200 may be a mobile terminal carried by an operator of the excavator 100. The assisting device 200 may be a stationary terminal device.

The managing device 300 is typically a stationary terminal device, and is, for example, a server computer (referred to as a "cloud server") installed in a management center outside the work site, or the like. Also, the managing device 300 may be, for example, an edge server installed at the work site. Also, the managing device 300 may be a portable terminal device (for example, a laptop computer terminal, a tablet terminal, or a mobile terminal such as a smartphone).

The assisting device 200 and the managing device 300 are information processing devices that communicate with the excavator 100, and at least one of them may include a monitor and an operating device for remote operation. In this case, the operator using the assisting device 200 or the manager using the managing device 300 may operate the excavator 100 by using the operating device for remote operation. The operating device for remote operation is communicably connected to the controller 30 mounted on the excavator 100, via a wireless communication network such as a short-range wireless communication network, a mobile phone communication network, or a satellite communication network.

Also, a variety of information (for example, image information showing the surroundings of the excavator 100, various configuration screens, etc.) displayed on the display device D1 installed in the cabin 10 may be also displayed on a display device connected to at least one of the assisting device 200 and the managing device 300. The image information showing the surroundings of the excavator 100 may be generated based on images captured by an image-capturing device (for example, a camera that serves as the space recognition device 70). By this means, the worker using the assisting device 200 or the manager using the managing device 300 can operate the excavator 100 remotely, configure various settings related to the excavator 100, and so forth, while checking the surroundings of the excavator 100.

For example, in the operation system SYS, the controller 30 of the excavator 100 may transmit information relating to at least one of the time and position that the switch SW is pressed, the target trajectory that is used to move the excavator 100 autonomously, and the tracks actually followed by a predetermined part during autonomous operation, to at least one of the assisting device 200 and the managing device 300.

At that time, the controller 30 may transmit images captured by the image-capturing device to at least one of the assisting device 200 and the managing device 300. The captured images may be multiple images captured during autonomous operation. Further, the controller 30 may transmit information relating to at least one of data about the details of operation of the excavator 100 during autonomous operation, data about the attitude of the excavator 100, and data about the attitude of the excavation attachment, to at least one of the assisting device 200 and the managing device 300. By this means, the worker using the assisting device 200 or the manager using the managing device 300 can obtain information about the excavator 100 engaged in autonomous operation.

In this way, in the assisting device 200 or the managing device 300, the types and positions of monitoring objects outside the monitoring range of the excavator 100 are stored in a storage part in chronological order. Here, the objects (information) to be stored in the assisting device 200 or the managing device 300 may be the types and positions of monitoring objects that are located outside the monitoring range of the excavator 100, and that are located in other excavators' monitoring ranges.

In this way, the operation system SYS allows the operator of the excavator 100 to share information about the excavator 100 with the manager, other excavators' operators, and so forth.

Note that, as shown in FIG. 10, the communication device installed in the excavator 100 is configured to transmit and receive information, via wireless communication, to and from a communication device T2 installed in a remote operation room RC. In the example shown in FIG. 10, the communication device installed in the excavator 100 and the communication device T2 are configured to transmit and receive information via a 5th-generation mobile communication line (5G line), an LTE line, a satellite line, and so forth.

In the remote operation room RC, a remote controller 30R, a sound output device A2, an interior image-capturing device C2, a display device RD, a communication device T2, and so forth are installed. Also, in the remote operation room RC, a driver's seat DS is installed where the operator OP who remotely operates the excavator 100 sits.

The remote controller 30R is a calculation device that performs various calculations. According to the present embodiment, like the controller 30, the remote controller 30R, is constituted by a microcomputer including a CPU and a memory. Various functions of the remote controller 30R are implemented as the CPU executes programs stored in the memory.

In other words, the remote controller 30R is a controller that implements the same functions as those of the controller 30 described above.

The sound output device A2 is structured to output sound. With the present embodiment, the sound output device A2 is a speaker and structured to play sounds collected by a sound collection device (not shown) attached to the excavator 100.

The interior image-capturing device C2 is structured to capture images inside the remote operation room RC. With the present embodiment, the interior image-capturing device C2 is a camera installed inside the remote operation room RC, and structured to capture images of the operator OP seated in the driver's seat DS.

The communication device T2 is structured to control wireless communication with a communication device attached to the excavator 100.

With the present embodiment, the driver's seat DS has a similar structure to the driver's seat installed in the cabin 10 of a common excavator. To be more specific, a left console box is positioned on the left side of the driver's seat DS, and a right console box is positioned on the right side of the driver's seat DS. A left operating lever is positioned at the front end of the upper surface of the left console box, and a right operating lever is positioned at the front end of the upper surface of the right console box. A drive lever and a drive pedal are positioned in front of the driver's seat DS. Furthermore, a dial 75 is positioned at the center of the upper surface of the right console box. The left operating lever, right operating lever, drive lever, and drive pedal all constitute an operating device 26A.

The dial 75 is for adjusting the number of rotations of the engine 11 per unit time, and is structured such that, for example, the engine speed can be switched in four steps.

To be more specific, the dial 75 is structured such that the engine speed can be switched in four steps, namely SP mode, H mode, A mode, and idling mode. The dial 75 transmits data about the setting related to engine speed to the controller 30.

SP mode is the rotation speed mode selected when the operator OP wants to prioritize the amount of work, and uses the highest engine speed. H mode is the rotation speed mode selected when the operator OP wants to have a balance between the amount of work and fuel efficiency, and uses the second highest engine speed. A mode is the rotation speed mode selected when the operator OP wants to operate the excavator with low noise while prioritizing fuel efficiency, and uses the third highest engine speed. Idling mode is the rotation speed mode selected when the operator OP wants to place the engine in an idling state, and uses the lowest engine speed. Then, the engine 11 is controlled to rotate at a constant rotation speed, that is, at the engine speed of the rotation speed mode selected via the dial 75.

The operating device 26A is provided with an operation sensor 29A for detecting the details of operation on the operating device 26A. The operation sensor 29A is, for example, a tilt sensor that detects the tilt angle of the operating lever, or an angle sensor that detects the swing angle of the operating lever about the swing axis. The operation sensor 29A may be constituted by other sensors such as a pressure sensor, a current sensor, a voltage sensor, a distance sensor, and so forth. The operation sensor 29A outputs information about the details of operation detected with respect to the operating device 26A, to the remote controller 30R. The remote controller 30R generates an operation signal based on the received information, and transmits the generated operation signal to the excavator 100. The operation sensor 29A may be configured to generate an operation signal. In this case, the operation sensor 29A may output the operation signal to the communication device T2 without going through the remote controller 30R.

The display device RD is structured to display information about the situation surrounding the excavator 100. With the present embodiment, the display device RD is a multi-display constituted by nine monitors, namely three columns and three rows of monitors, and structured such that it can display the space in front of, to the left of, and to the right of the excavator 100. Each monitor is a liquid crystal monitor, an organic EL monitor, or the like. However, the display device RD may be constituted by one or more curved monitors, or may be a projector. Also, the display device RD may be configured such that it can display the space in front of, to the left of, to the right of, and rear of the excavator 100.

The display device RD may be a display device that can be worn by the operator OP. For example, the display device RD may be a head-mounted display, and configured such that information can be transmitted and received between the display device RD and the remote controller 30R via wireless communication. The head mounted display may be wired to the remote controller 30R. The head-mounted display may be a transmissive head-mounted display or a non-transmissive head-mounted display. The head mounted display may be a monocular head mounted display, or may be a binocular head mounted display.

The display device RD is structured to display images that allow the operator OP in the remote operation room RC to view the surroundings of the excavator 100. In other words, the display device RD displays images such that the operator can check the situation surrounding the excavator 100 as if he/she were inside the cabin 10 of the excavator 100 even though he/she is in the remote operation room RC.

Although an embodiment for carrying out the present invention has been described above, the above-described details by no means limit the present invention, and various alterations and improvements can be made within the scope of the present invention.

What is claimed is:

1. An excavator comprising:

an attachment including a plurality of moving elements; and a hardware processor configured to, as a machine control function, calculate, with respect to each of the plurality of moving elements, a vertical component of a velocity vector of a control reference point on the attachment with respect to a target working surface, using information on operation details pertaining to said each of the plurality of moving elements, compare the calculated vertical components to determine a smallest vertical component, select a moving element corresponding to the determined smallest vertical component among the plurality of moving elements as a master element and specify a moving element other than the master element among the plurality of moving elements as a slave element, and cause the slave element to move in accordance with a movement of the master element.

2. The excavator according to claim 1, wherein the hardware processor is configured to calculate a slave command value for the slave element by using information on operation details pertaining to the master element.

3. The excavator according to claim 2, wherein the hardware processor is configured to calculate the slave command value based on data about the target working surface, a current position of an end attachment included in the plurality of moving elements, and an angular velocity of the master element.

4. The excavator according to claim 3, wherein the plurality of moving elements include a boom, an arm, and a bucket, and wherein the master element is selected from among the boom, the arm, and the bucket.

5. The excavator according to claim 4, wherein the hardware processor is configured to stop operation of the excavator when the control reference point is within a predetermined range from the target working surface and information on operation details pertaining to only one moving element among the plurality of moving elements is received as input.

6. The excavator according to claim 4, wherein the hardware processor is configured to, when the control reference point is within the predetermined range from the target working surface and information on operation details pertaining to only one moving element among the plurality of moving elements is received as input, receive operation for the arm and control movement of the boom and the bucket in accordance with the operation for the arm.

7. The excavator according to claim 5, wherein the hardware processor is configured to activate the machine control function when a switch provided in an operating device is pressed.

8. The excavator according to claim 5, wherein the hardware processor is configured to activate the machine control function when teeth of the bucket enter the predetermined range from the target working surface.

9. An excavator operation system comprising:

an excavator including an attachment, the attachment including a plurality of moving elements; and a hardware processor configured to, as a machine control function, calculate, with respect to each of the plurality of moving elements, a vertical component of a velocity vector of a control reference point on the attachment with respect to a target working surface, using information on operation details pertaining to said each of the plurality of moving elements, compare the calculated vertical components to determine a smallest vertical component, select a moving element corresponding to the determined smallest vertical component among the plurality of moving elements as a master element and specify a moving element other than the master element among the plurality of moving elements as a slave element, and cause the slave element to move in accordance with a movement of the master element.

10. The excavator according to claim 1, wherein the hardware processor is further configured to limit a movement of the slave element in accordance with the movement of the master element such that the slave element moves according to an amount of operation smaller than an input amount of operation.

11. The excavator according to claim 10, wherein the hardware processor is further configured to generate a command value for the slave element smaller than a command value corresponding to the input amount of operation and limit the movement of the slave element based on the generated command value.

12. The excavator according to claim 10, wherein the hardware processor is further configured to move the master element in accordance with an input operation.

13. The excavator according to claim 1, wherein the hardware processor is further configured to calculate a first vertical component of the velocity vector of the control reference point using information on operation details pertaining to a first moving element among the plurality of moving elements and a second vertical component of the velocity vector of the control reference point using information on operation details pertaining to a second moving element among the plurality of moving elements, and select the first moving element as the master element and select the second moving element as the slave element in response to determining that the first vertical component is smaller than the second vertical component.

14. The excavator according to claim 13, wherein the hardware processor is further configured to calculate a third vertical component of the velocity vector of the control reference point using information on operation details pertaining to a third moving element among the plurality of moving elements, and select the first moving element as the master element and select each of the second moving element and the third moving element as the slave element in response to determining that the first vertical component is smaller than the second vertical component and the third vertical component.

15. The excavator according to claim 14, wherein the plurality of moving elements include a boom, an arm, and a bucket, and the hardware processor is configured to select one of the boom, the arm, or the bucket as the master element and specify each of the other two of the boom, the arm, or the bucket as the slave element.

16. The excavator according to claim 1, wherein the hardware processor is configured to determine whether the machine control function is activated, and acquire the information on the operation details pertaining to said each of the plurality of moving elements in response to determining that the machine control function is activated.

17. The excavator according to claim 16, wherein the hardware processor is configured to determine that the machine control function is activated in response to a switch provided in an operating device being pressed.

18. The excavator according to claim 1, wherein the hardware processor is configured to automatically activate the machine control function in response to teeth of the bucket entering a predetermined range from the target working surface, and acquire the information on the operation details pertaining to said each of the plurality of moving elements in response to activating the machine control function.

19. The excavator according to claim 1, wherein the information on the operation details pertaining to said each of the plurality of moving elements includes a direction of operation and an amount of operation of an operating device pertaining to said each of the plurality of moving elements.

20. The excavator according to claim 1, wherein the hardware processor is configured to calculate an angular velocity of said each of the plurality of moving elements based on the information on the operation details pertaining to said each of the plurality of moving elements, data on the target working surface, and a current position of the control reference point, determine the velocity vector of the control reference point with respect to said each of the plurality of moving elements from the calculated angular velocity of said each of the plurality of moving elements, and calculate the vertical component of the determined velocity vector with respect to the target working surface with respect to said each of the plurality of moving elements.

* * * * *